US007074540B2

(12) United States Patent
Nukada et al.

(10) Patent No.: US 7,074,540 B2
(45) Date of Patent: Jul. 11, 2006

(54) IMAGE FORMING APPARATUS

(75) Inventors: Katsumi Nukada, Minamiashigara (JP); Kazuhiro Koseki, Minamiashigara (JP); Wataru Yamada, Minamiashigara (JP); Takayuki Yamashita, Minamiashigara (JP); Masahiro Iwasaki, Minamiashigara (JP); Takahiro Suzuki, Minamiashigara (JP); Kiyoshi Chatani, Minamiashigara (JP); Yoshinari Ueno, Minamiashigara (JP); Hidekazu Yaguchi, Minamiashigara (JP); Kazuhiko Yanagida, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 103 days.

(21) Appl. No.: 10/976,819

(22) Filed: Nov. 1, 2004

(65) Prior Publication Data

US 2005/0089788 A1 Apr. 28, 2005

Related U.S. Application Data

(63) Continuation of application No. 10/373,797, filed on Feb. 27, 2003, now abandoned.

(30) Foreign Application Priority Data

Sep. 20, 2002 (JP) ..... 2002-276005

(51) Int. Cl.
*G03G 21/10* (2006.01)

(52) U.S. Cl. ..... 430/125; 399/353; 399/358

(58) Field of Classification Search ..... 430/125, 430/110.3, 58.2; 399/353, 358
See application file for complete search history.

(56) References Cited

U.S. PATENT DOCUMENTS

| | | | | |
|---|---|---|---|---|
| 2,297,691 | A * | 10/1942 | Carlson | 430/55 |
| 4,791,455 | A * | 12/1988 | Yamamoto et al. | 399/345 |
| 4,931,841 | A | 6/1990 | Yoshihara | |
| 5,339,138 | A | 8/1994 | Mishima et al. | |
| 5,357,323 | A | 10/1994 | Haneda et al. | |
| 5,879,847 | A | 3/1999 | Yoshinaga et al. | |
| 6,296,978 | B1 | 10/2001 | Takaya et al. | |
| 6,442,367 | B1 | 8/2002 | Itami et al. | |
| 2001/0018003 | A1 * | 8/2001 | Waterschoot | 399/353 |
| 2003/0039913 | A1 * | 2/2003 | Kadokura et al. | 430/110.3 |
| 2003/0215266 | A1 | 11/2003 | Ishida et al. | |
| 2004/0076901 | A1 | 4/2004 | Miyamoto et al. | |

FOREIGN PATENT DOCUMENTS

| | | |
|---|---|---|
| JP | A 47-30330 | 11/1972 |
| JP | A 61-239279 | 10/1986 |

(Continued)

OTHER PUBLICATIONS

Diamond, Authur S. (ed.) Handbook of Imaging Materials. New York: Marcel-Dekker, Inc. (1991) pp. 160-163.*

(Continued)

*Primary Examiner*—Christopher Rodee
(74) *Attorney, Agent, or Firm*—Oliff & Berridge, PLC

(57) ABSTRACT

An image forming apparatus is capable of performing image formation at a processing speed of not lower than 150 mm/s. An electrophotographic photoreceptor comprises a surface layer containing a siloxane-bases resin having charge-transporting properties and a crosslinked structure. A cleaning device comprises a brush member disposed such that the leading end of said brush comes in contact with said electrophotographic photoreceptor. The product ($R_z \times W_e$) of the surface roughness ($R_z$ [μm]) of said electrophotographic photoreceptor after 200,000 rotations thereof and the wear rate of said electrophotographic photoreceptor per 1,000 rotations ($W_e$ [nm]) is not greater than 20.

12 Claims, 5 Drawing Sheets

FOREIGN PATENT DOCUMENTS

| | | | |
|---|---|---|---|
| JP | A 1-312578 | | 12/1989 |
| JP | A 4-189873 | | 7/1992 |
| JP | 4-317093 | | 11/1992 |
| JP | A 5-43823 | | 2/1993 |
| JP | A 5-98181 | | 4/1993 |
| JP | A 5-140472 | | 6/1993 |
| JP | A 5-263007 | | 10/1993 |
| JP | A 5-279591 | | 10/1993 |
| JP | A 07219246 | | 8/1995 |
| JP | A 8-176293 | | 7/1996 |
| JP | A 8-208820 | | 8/1996 |
| JP | 2001255682 A | * | 9/2001 |
| JP | A 2001-296781 | | 10/2001 |
| JP | A 2002-162878 | | 6/2002 |

OTHER PUBLICATIONS

Diamond, Arthur S. (editor) Handbook of Imaging Materials, 2nd edition. New Yuork: Marcel-Dekker, Inc. (2002) pp. 149-151.

* cited by examiner

IMAGE FORMING APPARATUS

This is a Continuation of application Ser. No. 10/373,797 filed Feb. 27, 2003, now abandoned. The entire disclosure of the prior application is hereby incorporated by reference herein in its entirety.

FIELD OF THE INVENTION

The present invention relates to an image forming apparatus.

BACKGROUND OF THE INVENTION

As an image forming apparatus which undergoes an electrophotographic process involving electrostatic charging, exposure, development and transfer to form an image there has heretofore been known one comprising a cleaning blade made of an elastic material such as rubber for cleaning the surface of an electrophotographic photoreceptor from which a toner has been transferred. The use of a cleaning blade comprising an abrasive material incorporated in a rubber material has been proposed to remove attached materials from the surface of the electrophotographic photoreceptor efficiently (see Patent References 1 to 4 shown below).

Further, the use of a cleaning device comprising an auxiliary brush disposed in contact with the electrophotographic photoreceptor above the cleaning blade has been proposed (see Patent Reference 5 shown below). In the cleaning device, attached materials are peeled off the surface of the electrophotographic photoreceptor by the auxiliary brush. The attached matters having a lowered attraction force are then removed by the cleaning blade.

Patent Reference 1: JP-A-61-239279
Patent Reference 2: JP-A-317093
Patent Reference 3: JP-A-2001-296781
Patent Reference 4: JP-A-2002-162878
Patent Reference 5: JP-A-1-312578

In recent years, image forming apparatus have been developed to have higher operation speed and higher performance. At the same time, image forming apparatus have been required more and more to have a prolonged life. Accordingly, the various members constituting image forming apparatus have been required to have a higher reliability. However, the electrophotographic photoreceptor of the related art image forming apparatus leaves something to be desired in reliability.

In other words, in the case where a cleaning blade is used, the external additives for the toner, etc. are agglomerated on the edge of the blade. The vibration of the blade with the operation of the electrophotographic photoreceptor (stick slip phenomenon) causes the agglomerated material to be fixed to the surface of the electrophotographic photoreceptor, occasionally causing filming. This filming is a phenomenon which can be remarkably seen with color image forming apparatus which perform image formation by overlapping a plurality of color toner images.

It is very difficult to enhance the strength of both the electrophotographic photoreceptor and the cleaning blade in harmony with each other. When the strength of one of the two members is greater than that of the other, the member having a lower strength is often subject to damage. In some detail, the sliding movement of the electrophotographic photoreceptor and the cleaning blade with each other causes the electrophotographic photoreceptor or cleaning blade to be scratched, abraded or chipped. As a result, image defects can easily occur. In particular, in the case where a fine particulate toner having a spherical form having a reduced diameter is used for higher image quality, it is necessary that the contact pressure across the electrophotographic photoreceptor and the cleaning blade be predetermined high to prevent the toner from passing through the gap between the two members. This causes the electrophotographic photoreceptor or cleaning blade to be easily damaged. Further, when the contact pressure across the electrophotographic photoreceptor and the cleaning blade is predetermined high, the resulting bending of the cleaning blade or uneven rotation of the electrophotographic photoreceptor can cause the deterioration of image quality.

Moreover, in the case where the cleaning blade is used in combination with an auxiliary brush as in the image forming apparatus described in Patent Reference 5, the auxiliary brush can cause the surface of the electrophotographic photoreceptor to be scratched (scratch mark). Further, when the tip of the auxiliary brush repeatedly runs along the scratch mark as if it acts as a stylus, the surface of the electrophotographic photoreceptor is scratched more deeply than in the case where only the cleaning blade is used, resulting in remarkable deterioration of image quality.

SUMMARY OF THE INVENTION

The invention has been worked out in the light of the aforementioned problems in the related art.

That is, an object of the invention is to provide an image forming apparatus which can prevent the deterioration of function of the electrophotographic photoreceptor and the cleaning device during use to realize high operation speed, high performance and prolonged life.

Other objects and effects of the invention will become apparent from the following description.

The above-described objects of the present invention have been achieved by providing an image forming apparatus of the invention comprises:

an electrophotographic photoreceptor having an electrically-conductive support and a photosensitive layer provided on the support;

an electrostatic charging unit for electrostatically charging the electrophotographic photoreceptor;

an exposing unit for exposing the electrostatically charged electrophotographic photoreceptor to light to form an electrostatic latent image;

a developing unit for developing the electrostatic latent image with a toner to form a toner image;

a transferring unit for transferring the toner image onto a transferring medium; and a cleaning device for removing the toner left on the electrophotographic photoreceptor after the transfer of the toner image wherein said image forming apparatus is capable of performing image formation at a processing speed of not lower than 150 mm/s, wherein the electrophotographic photoreceptor comprises a surface layer containing a siloxane-based resin having charge-transporting properties and a crosslinked structure, wherein the cleaning device comprises a brush member disposed such that the leading end of the brush comes in contact with the electrophotographic photoreceptor, and wherein the product ($R_z \times W_e$) of the surface roughness ($R_z$ [μm]) of the electrophotographic photoreceptor after 200,000 rotations thereof and the wear rate of the electrophotographic photoreceptor per 1,000 rotations ($W_e$ [nm]) is not greater than 20.

In accordance with the invention, the image forming apparatus may have the following features. The electrophotographic photoreceptor comprises a surface layer containing a siloxane-based resin having charge-transporting property and a crosslinked structure. A brush member is disposed in contact with the electrophotographic photoreceptor. The product ($R_z \times W_e$) of the surface roughness. ($R_z$ [μm]) of the electrophotographic photoreceptor after 200,000 rotations thereof and the wear rate of the electrophotographic photoreceptor per 1,000 rotations ($W_e$ [nm]) is not greater than 20. In this arrangement, it is made sure that the remaining toner can be removed without causing damage on the electrophotographic photoreceptor, filming by agglomerated external additives for toner, passage of toner, etc. The resulting image forming apparatus can be provided with a higher operation speed, a higher performance and a prolonged life.

In the present invention, the image forming apparatus may have the following features. The brush member is obtained by arranging resin fibers made of a material selected from the group consisting of polyamide, polyacrylate, polyolefin and polyester, having a fiber diameter of not greater than 30 denier at a density of not smaller than 20,000 fibers/inch, and the intrusion depth of the leading end of the brush into the electrophotographic photoreceptor is from 0.1 to 2.5 mm. In this arrangement, the surface roughness and the wear rate of the electrophotographic photoreceptor can be easily and securely controlled to satisfy the aforementioned conditions, making it possible to provide the image forming apparatus with a further higher operation speed, a further higher performance and a further longer life.

In the present invention, the image forming apparatus may have the following features. The brush member is electrically conductive and a predetermined voltage is applied across the electrophotographic photoreceptor and the brush member to remove the toner left on the electrophotographic photoreceptor. In this arrangement, the efficiency of removal of remaining toner can be further enhanced. When electrolysis occurs across the electrophotographic photoreceptor and other members in an image forming apparatus of related art, discharge occurs in the vicinity of point at which the two materials come in contact with each other, possibly causing deterioration of the surface of the electrophotographic photoreceptor. On the contrary, in the invention, an electrophotographic photoreceptor having a surface layer containing the aforementioned specific siloxane-based resin is used. The use of the excellent mechanical strength and dielectric characteristics of the siloxane-based resin makes it possible to sufficiently prevent the deterioration of the surface of the electrophotographic photoreceptor due to the application of voltage.

In accordance with the image forming apparatus of the invention, the toner may have an average shape factor of from 115 to 140. In the invention, even when the toner having an average shape factor of from 115 to 140 is used, a phenomenon can be prevented that the toner passes through the gap between the electrophotographic photoreceptor and the blade member, making it possible to maintain a high level image quality over an extended period of time.

In the image forming apparatus of the invention, the brush member may be a roll-shaped brush member which can rotate around a rotational axis parallel to a line tangential to the electrophotographic photoreceptor. The cleaning device may comprise a recovery roll member which is disposed so as to come in contact with the leading end of the brush member and which can rotate around a rotational axis parallel to the rotational axis of the brush member, and a scraper or blade member disposed in contact with the periphery of the recovery roll member. In this arrangement, the remaining toner attached to the roll-shaped brush member can be removed by the recovery roll member and the remaining toner attached to the recovery roll member can then be removed by the scraper or blade member, making it possible to regenerate the brush member and the recovery roll and hence maintain high level cleaning properties over an extended period of time.

Further, in the image forming apparatus of the invention, the surface layer of the electrophotographic photoreceptor may further comprise aluminum in an amount of from 0.1 to 10% by weight. In this arrangement, the hardness of the electrophotographic photoreceptor is enhanced, making it possible to effectively inhibit the rise of residual potential and hence further improve the electrophotographic properties of the electrophotographic photoreceptor.

Moreover, in the image forming apparatus of the invention, the surface layer of the electrophotographic photoreceptor may further comprise a fine particulate material having an average particle diameter of from 5 nm to 1,000 nm in an amount of from 0.1 to 30% by weight. In this arrangement, the surface properties such as resistance to attachment of contaminants and lubricating property of the surface of the electrophotographic photoreceptor can be further improved.

Further, in the image forming apparatus of the invention, the surface layer of the electrophotographic photoreceptor may further comprise an alcohol-soluble resin in an amount of from 5 to 20% by weight. In this arrangement, the discharge gas resistance, mechanical strength, scratch resistance, particle dispersibility, etc. of the electrophotographic photoreceptor can be further improved. Moreover, an effect of reducing torque during the rotation of the electrophotographic photoreceptor and prolonging the pot life of the surface layer-forming coating solution can be exerted. Further, the viscosity of the surface layer-forming coating solution and the wear rate of the electrophotographic photoreceptor can be easily controlled.

Moreover, in the image forming apparatus of the invention, the surface layer of the electrophotographic photoreceptor may further comprise an oxidation inhibitor in an amount of from 0.1 to 20% by weight. In the invention, the incorporation of the aforementioned specific siloxane-based resin in the surface layer of the electrophotographic photoreceptor allows the oxidation inhibitor thus incorporated to be uniformly dispersed and stably retained in the surface layer, making it possible to obtain high level oxidation inhibition properties.

Further, in the image forming apparatus of the invention, the siloxane-based resin may be obtained from a silicon-containing compound represented by the following general formula (1):

$$W(\text{-}D\text{-}SiR_{3-a}Q_a)_b \quad (1)$$

wherein W represents an organic group having charge-transporting property; R represents one group selected from the group consisting of hydrogen atom, alkyl group and substituted or unsubstituted aryl group; Q represents a hydrolyzable group; D represents a divalent group; the suffix a represents an integer of from 1 to 3; and the suffix b represents an integer of from 1 to 4. The incorporation of a siloxane-based resin obtained from such a silicon-containing compound in the surface layer of the electrophotographic photoreceptor makes it possible to further enhance the electrophotographic properties, mechanical strength, dielectric strength, etc. of the electrophotographic photoreceptor.

Further, the silicon-containing compound is preferably a compound represented by the following general formula (2):

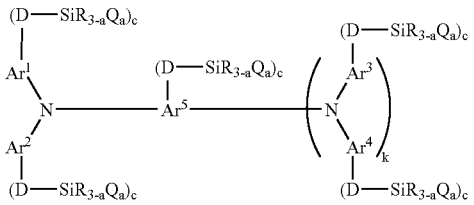

(2)

wherein $Ar^1$ to $Ar^4$ may be the same or different and each represent a substituted or unsubstituted aryl group; $Ar^5$ represents a substituted or unsubstituted aryl or arylene group: R represents one group selected from the group consisting of hydrogen atom, alkyl group and substituted or unsubstituted aryl group; Q represents a hydrolyzable group; D represents a divalent group; the suffix a represents an integer of from 1 to 3; and the suffixes c each independently represent 0 or 1, with the proviso that the total number of the groups represented by $-D-SiR_{3-a}Q_a$ is from 1 to 4.

Moreover, in the image forming apparatus of the invention, the photosensitive layer of the electrophotographic photoreceptor may comprise at least one phthalocyanine compound.

Figure 1:
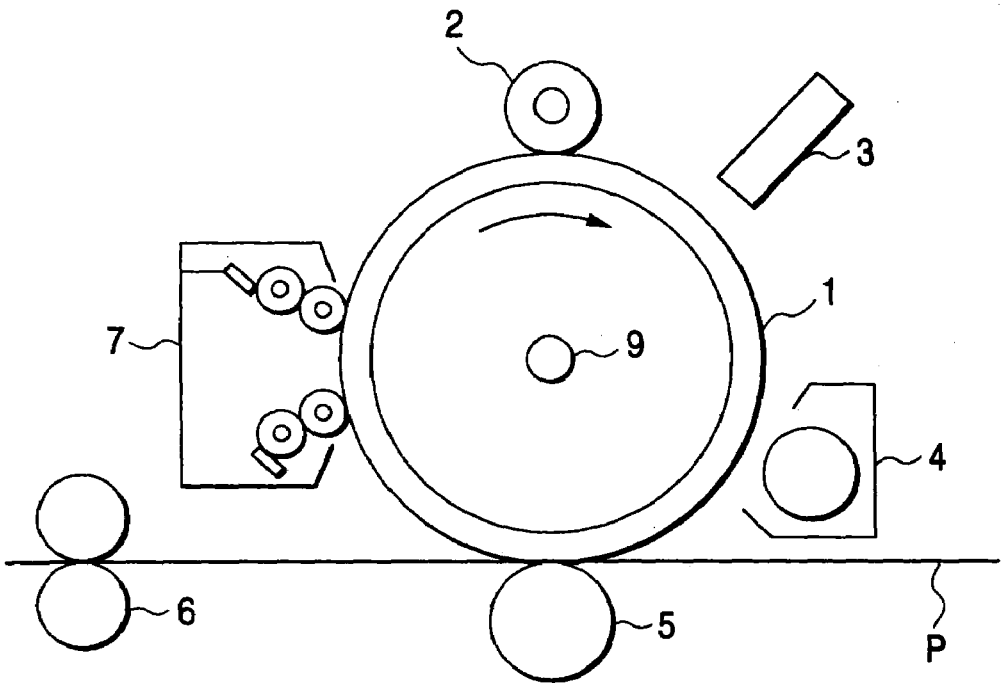
FIG. 1 is a schematic structural view illustrating an image forming apparatus according to the first embodiment of the invention.

The reference numerals used in the drawings represent the followings, respectively.

1: Electrophotographic photoreceptor;
11: Electrically-conductive support:
12: Photosensitive layer;
13: Subbing layer;
14: Charge-generating layer;
15: Charge-transporting layer;
16: Protective layer;
17: Charge-generating/charge-transporting layer;
2, 42: charging unit;
43: Exposing unit;
4, 44: Developing unit;
5, 45: Transferring unit;
6: Image fixing unit;
7, 46: Cleaning device;
700: Housing member;
701*a*, 701*b*: Roll-shaped brush member,
702*a*, 702*b*: Recovery roll member;
703*a*, 703*b*: Scraper:
704*a*, 704*b*, 705*a*, 705*b*: Shaft;
706: Fixing metal;
40: Image forming apparatus;
47: Belt conveying unit;
48: conveying belt;
49: Suspension roll;
55: Adsorption roll:
56: Fixing roll;
57: Receiving tray;
58: Tension roll;
59: Belt cleaner;
60: Recording material supplying unit

DETAILED DESCRIPTION OF THE INVENTION

Preferred embodiments of the invention will be described in detail below in connection with the attached drawings. In the various views, the same reference numerals are used to represent the same or corresponding parts. Repeated description will be omitted for such the same parts.

FIG. 1 is a schematic structural view illustrating an image forming apparatus according to the first embodiment of the invention. In the apparatus shown in FIG. 1, an electrophotographic photoreceptor 1 is supported by a support 9 and can rotate with the support 9 as a rotational axis in the direction shown by the arrow at a predetermined rotary speed. An charging unit 2, an exposing unit 3, a development unit 4, a transferring unit 5, and a cleaning device 7 are disposed in this order along the direction of rotation of the electrophotographic photoreceptor 1. In the image forming apparatus shown, electrostatic charging, exposure, development and transfer are sequentially effected at a processing rate of not lower than 150 mm/s at the procedure of rotation of the electrophotographic photoreceptor 1 to form an image on a transferring medium P. After the transferring step, the transferring medium P is conveyed to an image fixing unit 6 where it is then subjected to image fixing.

The various elements constituting the aforementioned apparatus will be further described hereinafter.

Electrophotographic Photoreceptor

The electrophotographic photoreceptor 1 comprises a surface layer containing a siloxane-based resin having charge-transporting properties and a crosslinked structure. The product ($R_z \times W_e$) of the surface roughness ($R_z$ [μm]) of the electrophotographic photoreceptor after 200,000 rotations thereof and the wear rate of the electrophotographic photoreceptor per 1,000 rotations ($W_e$[nm]) is not greater than 20.

The term "surface roughness ($R_z$ [μm]) as used herein is meant to indicate ten point-average surface roughness as measured according to the method defined in JIS B0601 (1994).

FIGS. 2 to 6 each is a schematic diagram illustrating a section of an electrophotographic photoreceptor. The electrophotographic photoreceptor 1 shown in FIGS. 2 to 4 comprises a photosensitive layer having a charge-generating layer and a charge-transporting layer separately provided therein (function-separating photoreceptor). The electrophotographic photoreceptor shown in FIGS. 5 and 6 comprises a layer containing both a charge-generating material and a charge-transporting layer (single layer type photosensitive layer). These electrophotographic photoreceptors will be further described hereinafter.

Figure 2:
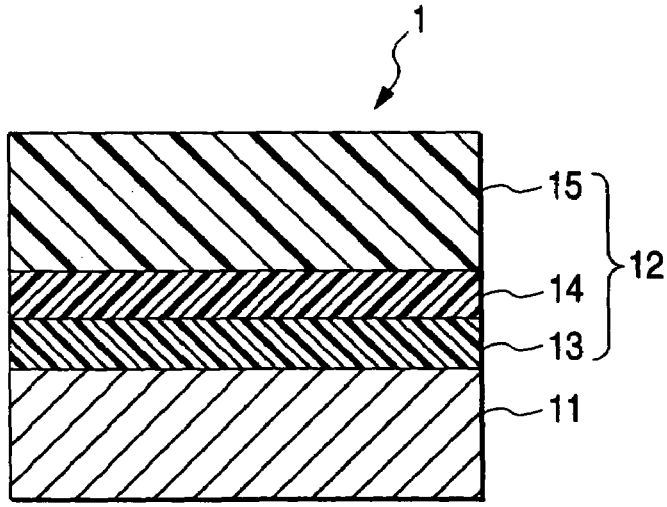
FIG. 2 is a schematic sectional view illustrating an example of the electrophotographic photoreceptor used in the invention.
Figure 3:
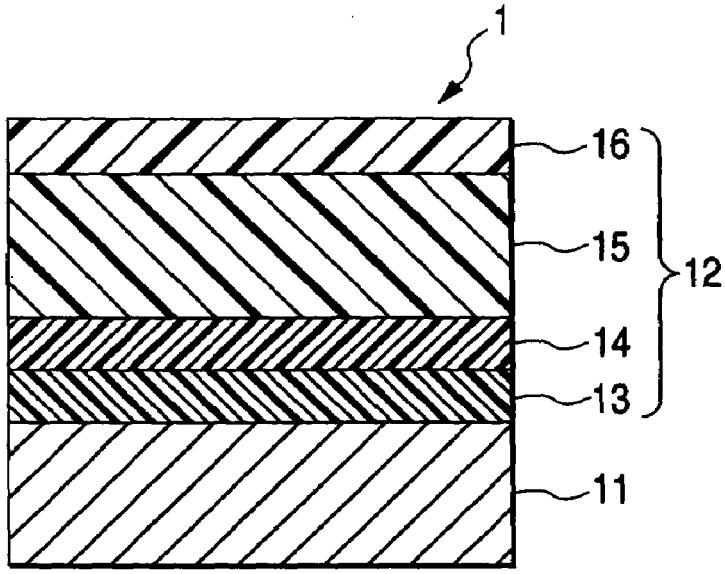
FIG. 3 is a schematic sectional view illustrating another example of the electrophotographic photoreceptor used in the invention.
Figure 4:
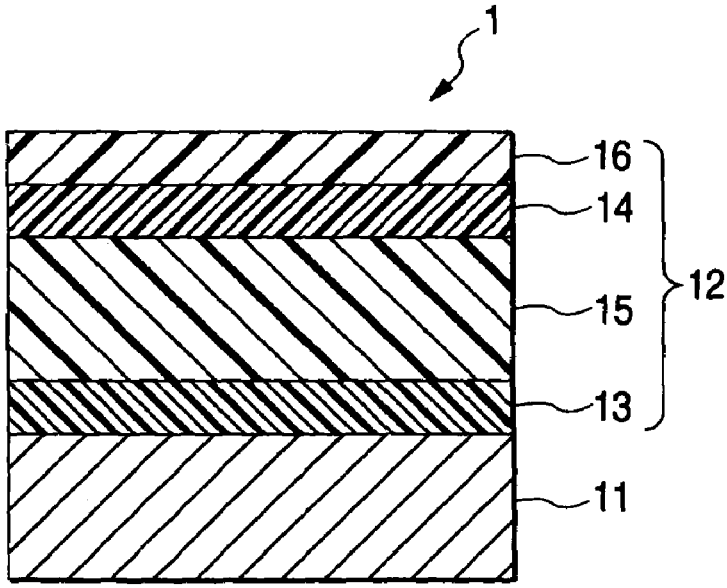
FIG. 4 is a schematic sectional view illustrating a further other example of the electrophotographic photoreceptor used in the invention.
Figure 5:
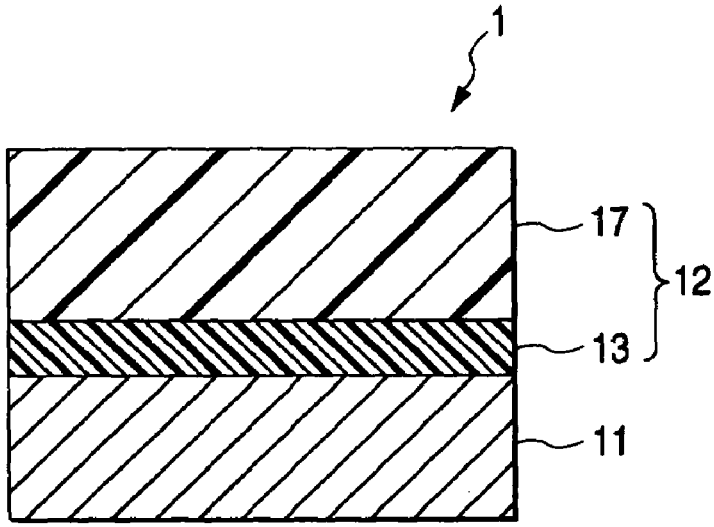
FIG. 5 is a schematic sectional view illustrating a still other example of the electrophotographic photoreceptor used in the invention.
Figure 6:
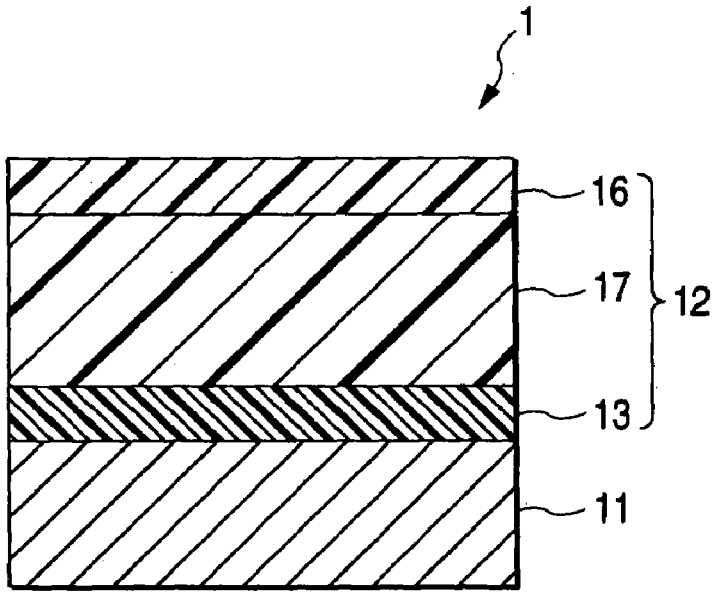
FIG. 6 is a schematic sectional view illustrating a still other example of the electrophotographic photoreceptor used in the invention.

In FIG. 2, a subbing layer 13, a charge-generating layer 14, and a charge-transporting layer 15 are provided on an electrically-conductive support 11 in this order to form a photosensitive layer 12. In FIG. 3, a subbing layer 13, a charge-generating layer 14, a charge-transporting layer 15, and a protective layer 16 are provided on an electrically-conductive support 11 in this order to form a photosensitive layer 12. In FIG. 4, a subbing layer 13, a charge-transporting layer 15, a charge-generating layer 14, and a protective layer 16 are provided on an electrically-conductive support 11 in this order to form a photosensitive layer 12. In FIG. 5, a subbing layer 13 and a charge-generating/charge-transporting layer 17 are provided on an electrically-conductive support 11 in this order to form a photosensitive layer 12. In FIG. 6, a subbing layer 13, a charge-generating/charge-transporting layer 17, and a protective layer 16 are provided on an electrically-conductive support 11 in this order to form a photosensitive layer 12. The surface layer in these electrophotographic photoreceptors, i.e., the charge-transporting layer 15 in FIG. 2, the protective layer 16 in FIGS. 3, 4 and 6, and the charge-generating/charge-transporting layer 17 in FIG. 4 each comprise a siloxane-based resin having charge-transporting property and a crosslinked structure.

As the electrically-conductive support 11 there may be used, .e.g., drum-shaped, sheet-like or plate-like aluminum substrate. The electrically-conductive support 11 may be subjected to anodization, boemite treatment, honing or the like for the purpose of preventing injection and fringe and improving adhesion.

Examples of the material of the subbing layer 13 employable herein include organic zirconium compounds such as zirconium chelate compound, zirconium alkoxide compound and zirconium coupling agent, organic aluminum compounds such as aluminum chelate compound and aluminum coupling agent, and organic metal compounds such as antimony alkoxide compound, germanium alkoxide compound, indium alkoxide compound, indium chelate compound, manganese alkoxide compound, manganese chelate compound, tin alkoxide compound, tin chelate compound, aluminum silicone alkoxide compound, aluminum titanium alkoxide compound and aluminum zirconium alkoxide compound. Preferred among these compounds are organic zirconium compounds, organic titanyl compounds and organic aluminum compounds because they have a low residual potential and exhibit good electrophotographic properties. These organic metal compounds may comprise a silane coupling agent such as vinyl trichlorosilane, vinyl trimethoxysilane, vinyl triethoxysilane, vinyl tris-2-methoxyethoxysilane, vinyl triacetoxysilane, γ-glycidoxypropyl trimethoxysilane, γ-methacryloxylpropyl trimethoxysilane, γ-aminopropyl triethoxysilane, γ-chloropropyl trimethoxysilane, γ-2-aminoethylaminopropyl trimethoxysilane, γ-mercaptopropyl trimethoxysilane, γ-ureidopropyl triethoxysilane and β-3,4-epoxycyclohexyl trimethoxysilane incorporated therein to form the subbing layer 13. Further, a known binder resin which has heretofore been used in the subbing layer such as polyvinyl alcohol, polyvinyl methyl ether, poly-N-vinylimidazole, polyethylenoxide, ethyl cellulose, methyl cellulose, ethylene-acrylic acid copolymer, polyamide, polyimide, casein, gelatin, polyethylene, polyester, phenolic resin, vinyl chloride-vinyl acetate copolymer, epoxy resin, polyvinyl pyrrolidone, polyvinyl pyridine, polyurethane, polyglutamic acid and polyacrylic acid may be used. The mixing proportion of these components may be properly predetermined as necessary.

The subbing layer 13 may comprise an electron-transporting pigment incorporated and dispersed therein. Examples of the electron-transporting pigment employable herein include organic pigments such as perylene pigment, bisbenzimidazole perylene pigment, polycyclic quinone pigment, indigo pigment and quinacridone pigment disclosed in JP-A-47-30330, organic pigments such as bisazo pigment, and phthalocyanine pigment having an electrophilic substituent such as cyano group, nitro group, nitroso group and halogen atom, and inorganic pigments such as zinc oxide and titanium oxide. Preferred among these pigments are perylene pigment, bisbenzimidazole perylene pigment, polycyclic quinone pigment, zinc oxide and titanium oxide because they have high electron-transporting properties. When the amount of such an electron-transporting pigment to be used is too great, the resulting subbing layer exhibits a reduced strength resulting in the occurrence of film defectives. Therefore, the amount of such an electron-transporting pigment to be used is preferably not greater than 95% by weight, more preferably not greater than 90% by weight. The incorporation/dispersion of the electron-transporting pigment is accomplished by the use of ball mill, roll mill, sandmill, attritor, ultrasonic wave or the like. The incorporation/dispersion of the electron-transporting pigment is effected in an organic solvent. As the organic solvent there may be used any material which can dissolve the organic metal compound and resin therein but causes neither gelation nor agglomeration upon the incorporation/dispersion of the electron-transporting pigment. For example, ordinary organic solvents such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofurane, methylene chloride, chloroform, chlorobenzene and toluene may be used singly or in combination of two or more thereof.

The thickness of the subbing layer 13 is preferably from 0.1 to 30 μm, more preferably from 0.2 to 25 μm. As the coating method for applying the coating solution of the subbing layer 13 to the electrically-conductive support 11 there may be used an ordinary method such as blade coating method, meyer bar coating method, spray coating method, dip coating method, bead coating method, air knife coating method and curtain coating method. The coated material thus obtained is then dried to obtain the subbing layer. In general, drying is carried out by evaporating the solvent at a film-making temperature. In particular, the substrate which has been subjected to treatment with an acidic solution and boemite treatment can easily leave something to be desired in defective opacifying power and thus preferably has an interlayer formed therein.

The charge-generating layer 14 is a layer comprising a charge-generating material and a binder resin incorporated therein. Examples of the charge-generating material employable herein include azo pigments such as bisazo and trisazo, condensed ring aromatic pigments such as dibromoanthanthrone, perylene pigment, pyrrolopyrrole pigment, and flat cyanine pigment. Preferred among these charge-generating materials are metal phthalocyanine pigment and metal-free phthalocyanine pigment. In particular, hydroxygallium phthalocyanine disclosed in JP-A-5-263007 and JP-A-5-279591, chlorogallium phthalocyanine disclosed in JP-A-5-98181, dichlorotin phthalocyanine disclosed in JP-A-5-140472 and JP-A-4-189873, and titanyl phthalocyanine disclosed in JP-A-5-43823 are preferred.

The binder resin can be selected from various insulating resins. The binder resin can be selected also from organic photo-conductive polymers such as poly-N-vinylcarbazole, polyvinyl anthracene, polyvinylpyrene and polysilane. Preferred examples of the binder resin employable herein include polyvinyl butyral resin, polyarylate resin (e.g., polycondensation product of bisphenol A and phthalic acid), polycarbonate resin, polyester resin, phenoxy resin, vinyl chloride-vinyl acetate copolymer, polyamide resin, acrylic resin, polyacrylamide resin, polyvinylpyridine resin, cellulose resin, urethane resin, epoxy resin, casein, polyvinyl alcohol resin, and polyvinylpyrrolidone resin. These binder resins may be used singly or in combination of two or more thereof. The mixing proportion of the charge-generating material and the binder resin is preferably from 10:1 to 1:10.

The formation of the charge-generating layer 14 may be carried out by the use of a coating solution having a charge-generating material and a binder resin dispersed in a predetermined solvent. Examples of the solvent employable herein include methanol, ethanol, n-propanol, n-butanol, benzyl alcohol, benzyl alcohol, methyl cellosolve, ethyl cellosolve, acetone, methyl ethyl ketone, cyclohexanone, methyl acetate, n-butyl acetate, dioxane, tetrahydrofurane, methylene chloride, chloroform, chlorobenzene, and toluene. These solvents may be used singly or in admixture of two or more thereof. The dispersion of the charge-generating material and the binder resin in the solvent may be carried out by the use of an ordinary method such as ball mill dispersion methods attritor dispersion method and sandmill dispersion method. These dispersion methods make it possible to prevent the change of the crystal form of the charge-generating material due to dispersion. During the procedure of dispersion, it is effective to predetermine the average particle diameter of the charge-generating material to not greater than 0.5 μm, preferably not greater than 0.3 μm, more preferably not greater than 0.15 μm.

The formation of the charge-generating layer 14 is accomplished by the use of an ordinary method such as blade coating method, meyer bar coating methods spray coating method, dip coating method, bead coating method, air knife coating method and curtain coating method. The thickness of the charge-generating layer 14 thus obtained is preferably from 0.1 to 5 μm, more preferably from 0.2 to 2.0 μm.

The charge-transporting layer 15 may be formed with comprising a charge-transporting material and a binder resin incorporated therein or comprising a polymer charge-transporting material incorporated therein. In the case where no protective layer is provided so that the charge-transporting layer 15 acts as a surface layer as shown in FIG. 2, the charge-transporting layer 15 comprises a siloxane-based resin defined herein incorporated therein as an essential component. The siloxane-based resin used herein will be further described with reference to the protective layer 16.

Examples of the charge-transporting material employable herein include quinone compounds such as p-benzoquinone, chloranyl, bromanyl and anthraquinone, tetracyanoquinodimethane-based compounds, fluorenone compounds such as 2,4,7-trinitrofluorenone, electron-transporting compounds such as xanthone-based compound, cyanovinyl-based compound and ethylene-based compound, and positive hole-transporting compounds such as triarylamine-based compound, benzidine-based compound, arylalkane-based compound, aryl-substituted ethylene-based compound, stilbene-based compound, anthracene-based compound and hydrazone-based compound. These charge-transporting materials may be used singly or in admixture of two or more thereof.

As the charge-transporting material there may be also used a polymer charge-transporting material. As the polymer charge-transporting material there may be used any known material having charge-transporting properties such as poly-N-vinylcarbazole and polysilane. In particular, polyester-based polymer charge-transporting materials disclosed in JP-A-8-176293 and JP-A-8-208820 have high charge-transporting properties and thus are particularly preferred. These polymer charge-transporting materials themselves are film-making but may be used in admixture with the binder resins described later to form a film.

Examples of the binder resin to be incorporated in the charge-transporting layer include polycarbonate resin, polyester resin, methacrylic resin, acrylic resin, polyvinyl chloride resin, polyvinylidene chloride resin, polystyrene resin, polyvinyl acetate resin, styrene-butadiene copolymer, vinylidene chloride-acrylonitrile copolymer, vinyl chloride-vinyl acetate copolymer, vinyl chloride-vinyl acetate-maleic anhydride copolymer, silicone resin, silicone alkyd resin, phenol formaldehyde resin, styrene-alkyd resin, poly-N-vinylcarbazole, and polysilane. As described above, polymer charge-transporting materials such as polyester-based polymer charge-transporting material disclosed in JP-A-8-176293 and JP-A-8-208820 may be used. These binder resins may be used singly or in admixture of two or more thereof. The mixing proportion of the charge-transporting material and the binder resin is preferably from 10:1 to 1:5.

The formation of the charge-transporting layer 15 is accomplished by the use of a coating solution having a charge-transporting material and a binder resin dispersed in a predetermined solvent. As such a solvent there may be used an organic solvent such as aromatic hydrocarbon (e.g., benzene, toluene, xylene, chlorobenzene), ketone (e.g., acetone, 2-butanone), halogenated aliphatic hydrocarbon (e.g., methylene chloride, chloroform, ethylene chloride) and cyclic or straight-chain ether (e.g., tetrahydrofurane, ethyl ether), singly or in admixture of two or more thereof.

The thickness of the charge-transporting layer 15 is preferably from 5 to 50 μm, more preferably from 10 to 30 μm. As the coating method there may be used an ordinary method such as blade coating method, meyer bar coating method, spray coating method, dip coating method, bead coating method, air knife coating method and curtain coating method.

The protective layer 16 comprises a siloxane-based resin having charge-transporting properties and a crosslinked structure as an essential component, and may be formed by optionally using other binder resins, charge-transporting materials, fine particulate lubricating materials such as fluororesin and acrylic resin, electrically-conductive fine particulate materials, silicone-based or acrylic hard coating agents, etc.

As the siloxane-based resin to be used herein there is preferably used a silicon-containing compound having the structure represented by the following general formula (1), singly or in the form of product of polymerization with other polymerizable compounds.

$$W(\text{-}D\text{-}SiR_{3-a}Q_a)_b \quad (1)$$

wherein W represents an organic group having charge-transporting properties; R represents one group selected from the group consisting of hydrogen atom, alkyl group and substituted or unsubstituted aryl group; Q represents a hydrolyzable group; D represents a divalent group; the suffix a represents an integer of from 1 to 3; and the suffix b represents an integer of from 1 to 4.

In the general formula (1), W is an organic group having photocarrier-transporting properties derived from triarylamine-based compound, benzidine-based compound, arylalkane-based compound, aryl-substituted ethylene-based compound, stilbene-based compound, anthracene-based compound, hydrazone-based compound, quinone-based compound, fluorenone compound, xanthone-based compound, benzophenone-based compound, cyanovinyl-based compound, ethylene-based compound, etc.

In the general formula (1), R represents a hydrogen atom, alkyl group (preferably $C_1$–$C_5$ alkyl group) or substituted or unsubstituted aryl group (preferably $C_6$–$C_{15}$ substituted or unsubstituted aryl group) as mentioned above.

In the general formula (1), the hydrolyzable group represented by Q is a functional group which undergoes hydrolysis during the curing reaction of the compound represented by the general formula (1) to form a siloxane bond (Si—O—Si). Specific preferred examples of such a hydrolyzable group include hydroxyl group, alkoxy group, methyl ethyl ketoxim group, diethylamine group, acetoxy group, propenoxy group, and chloro group. Preferred among these hydrolyzable groups are groups represented by —OR" (in which R" represents a $C_1$–$C_{15}$ alkyl or trimethylsilyl group).

In the general formula (1), the divalent group represented by D is preferably a divalent hydrocarbon group represented by $—CH_nH_{2n}—$, $—C_nH_{2n-2}—$, $—C_nH_{2n-4}—$ (in which n is an integer of from 1 to 15, preferably from 2 to 10), $—CH_2—C_6H_4—$ or $—C_6H_4—C_6H_4—$, oxycarbonyl group (—COO—), thio group (—S—), oxy group (—O—), isocyano group (—N═CH—) or a divalent group having two or more thereof in combination. These divalent groups may have substituents such as alkyl group, phenyl group, alkoxy group and amino group in its side chains. When D is a preferred divalent group as mentioned above, a tendency is given that the organic silicate skeleton is provided with a proper flexibility to enhance the strength of the protective layer.

Particularly preferred among the silicon-containing compounds represented by the general formula (1) is one represented by the following general formula (2):

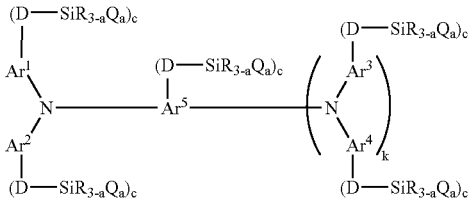

(2)

wherein $Ar^1$ to $Ar^4$ may be the same or different and each represents a substituted or unsubstituted aryl group; $Ar^5$ represents a substituted or unsubstituted aryl or arylene group; R represents one group selected from the group consisting of hydrogen atom, alkyl group and substituted or unsubstituted aryl group; Q represents a hydrolyzable group; D represents a divalent group; the suffix a represents an integer of from 1 to 3; and the suffixes c each independently represent 0 or 1, with the proviso that the total number of the groups represented by $-D-SiR_{3-a}Q_a$ is from 1 to 4.

$Ar^1$ to $Ar^4$ in the general formula (2) are preferably any of those of the following general formulae (3) to (9):

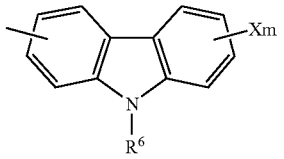

(3)

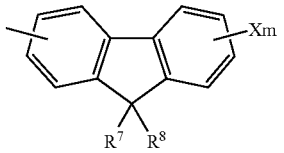

(4)

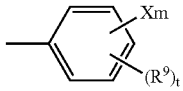

(5)

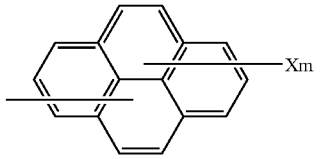

(6)

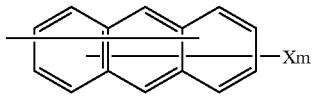

(7)

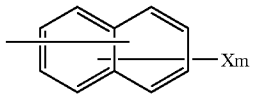

(8)

$—Ar-Z'_a—Ar-Xm$ (9)

wherein $R^6$ represents one selected from the group consisting of hydrogen atom, $C_1$–$C_4$ alkyl group, phenyl group substituted by $C_1$–$C_4$ alkyl or alkoxy group, unsubstituted phenyl group and $C_7$–$C_{10}$ aralkyl group; $R^7$ to $R^9$ each represent one selected from the group consisting of hydrogen atom, $C_1$–$C_4$ alkyl group, phenyl group substituted by $C_1$–$C_4$ alkyl or alkoxy group, unsubstituted phenyl group, $C_7$–$C_{10}$ aralkyl group and halogen atom; Ar represents a substituted or unsubstituted arylene group; X represents $-D-SiR_{3-a}Q_n$ in the general formula (2); m and s each represent an integer of 0 or 1; and t represents an integer of from 1 to 3.

Ar in the general formula (9) is preferably one represented by the following general formula (10) or (11):

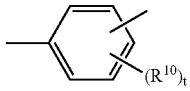

(10)

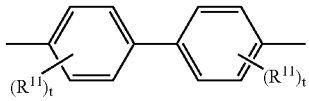

(11)

wherein $R^{10}$ and $R^{11}$ each represent one selected from the group consisting of hydrogen atom, $C_1$–$C_4$ alkyl group, $C_1$–$C_4$ alkoxy group, phenyl group substituted by $C_1$–$C_4$ alkoxy group, unsubstituted phenyl group, $C_7$–$C_{10}$ aralkyl group and halogen atom; and t represents an integer of from 1 to 3.

Z' in the general formula (10) is preferably one represented by any of the following general formulae (12) to (20):

$$—(CH_2)_q— \quad (12)$$

$$—CH_2CH_2O)_r— \quad (13)$$

(14)

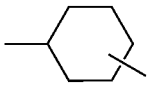

(15)

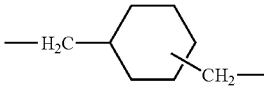

(16)

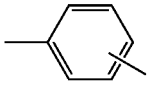

(17)

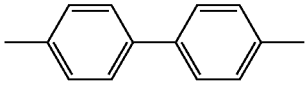

(18)

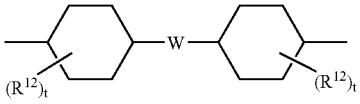

(19)

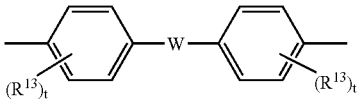

wherein $R^{12}$ and $R^{13}$ each represent one selected from the group consisting of hydrogen atom, $C_1$–$C_4$ alkyl group, $C_1$–$C_4$ alkoxy group, phenyl group substituted by $C_1$–$C_4$ alkoxy group, unsubstituted phenyl group, $C_7$–$C_{10}$ aralkyl group and halogen atom; W represents a divalent group; q and r each represent an integer of from 1 to 10; and t represents an integer of from 1 to 3.

W in the general formulae (18) and (19) is preferably any of divalent groups represented by the following general formulae (20) to (28):

$$—CH_2— \quad (20)$$

$$—C(CH_3)_2— \quad (21)$$

$$—O— \quad (22)$$

$$—S— \quad (23)$$

$$—C(CF_3)_2— \quad (24)$$

$$—Si(CH_3)_2— \quad (25)$$

(26)

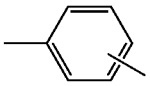

(27)

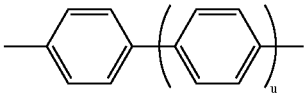

(28)

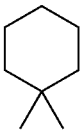

wherein u represents an integer of from 0 to 3.

In the general formula (2), $Ar^5$ represents an aryl group exemplified with reference to $Ar^1$ to $Ar^4$ when k is 0 or an arylene group obtained by removing predetermined hydrogen atom from such an aryl group when k is 1.

The polymerizable compound to be used in combination with the compound represented by the general formula (1) is not specifically limited so far as it has a group which can be bonded to silanol group produced upon the hydrolysis of the compound represented by the general formula (1). Specific examples of the polymerizable compound employable herein include compounds containing a group represented by $-D-SiR_{3-a}Q_a$, epoxy group, isocyanate group, carboxyl group, hydroxy group and halogen group. Preferred among these compounds are compounds a group represented by $-D-SiR_{3-a}Q_a$, and epoxy group, isocyanate group. Compounds having two or more such groups per molecule are desirable because they can form a cured film having a three-dimensional crosslinked structure that gives a higher mechanical strength. Preferred examples of such a polymerizable compound will be given in Table 1 below.

TABLE 1

| | |
|---|---|
| III-1 | 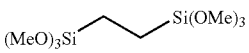 |
| III-2 | 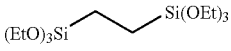 |
| III-3 | 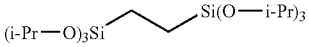 |
| III-4 | 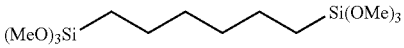 |

TABLE 1-continued

| | |
|---|---|
| III-5 | 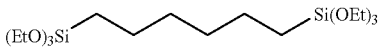 |
| III-6 | 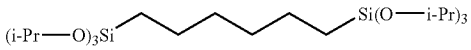 |
| III-7 | 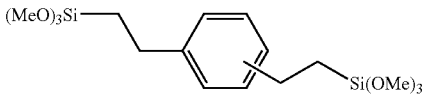 |
| III-8 | 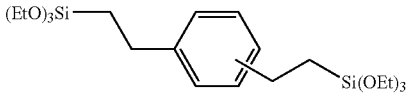 |
| III-9 | 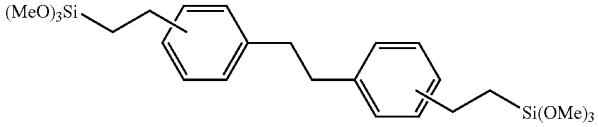 |
| III-10 | 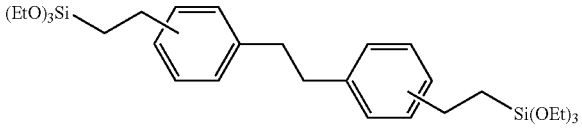 |
| III-11 | 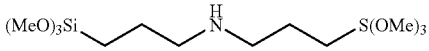 |
| III-12 | 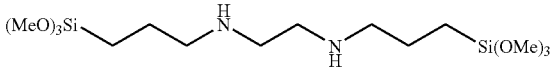 |
| III-13 | 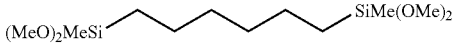 |
| III-14 | 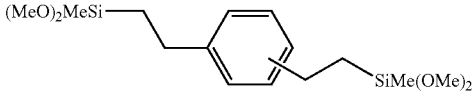 |
| III-15 | $(MeO)_3SiC_3H_6—O—CH_2CH\{—O—C_3H_6Si(OMe)_3\}—CH_2\{—O—C_3H_6Si(OMe)_3\}$ |

These polymerizable compounds may be used in admixture with other coupling agents and fluorine compounds for the purpose of adjusting film-forming properties and flexibility of film. As these compounds there may be used various silane coupling agents and commercially available silicone-based hard coating agents.

Examples of the silane coupling agents employable herein include vinyl trichlorosilane, vinyl trimethoxysilane, vinyl triethoxysilane, γ-glycidoxypropylmethyl diethoxysilane, γ-glycidoxypropylmethyl trimethoxysilane, γ-glycidoxypropylmethyl trimethoxysilane, γ-aminopropyl triethoxysilane, γ-aminopropyl trimethoxysilane, γ-aminopropylmethyl diemthoxysilane, N-β(aminoethyl)γ-aminopropyltriethoxysilane, tetramethoxysilane, methyl trimethoxysilane, and dimethyl dimethoxysilane. Examples of commercially available hard coating agents employable herein include KP-85, X-40-9740, X-40-2239 (produced by Shin-Etsu Silicone Co., Ltd.), AY42-440, AY42-441, and AY49-208 (produced by TORAY DOW CORNING CO., LTD.). The silane coupling agent may further comprise a fluorine compound such as (tridecafluoro-1,1,2,2-tetrahydrooctyl)triethoxysilane, (3,3,3-trifluoropropyl) trimethoxysilane, 3-(heptafluoroisopropoxy)propyltriethoxysilane, 1H,1H,2H,2H-perfluoroalkyltriethoxysilane, 1H,1H,2H,2H-perfluorodecyltriethoxysilane and 1H,1H,2H,2H-perfluorooctyl triethoxysilane incorporated therein to render itself water-repellent. The silane coupling agent may be used in an arbitrary amount. The amount of the fluorine-containing compound to be used is preferably not greater than 0.25 times by weight that of the fluorine-free compound. When the amount of the fluorine-containing compound to be used exceeds the above defined value, the film-forming properties of the crosslinked layer occasionally leave something to be desired. In order to enhance the strength of the crosslinked layer, a compound having two or more substituted silicon groups containing & hydrolyzable group represented by $-D-Si_{R3-a}Q_a$ is preferably used as well.

The protective layer 16 may further comprise an alcohol-soluble resin incorporated therein for the purpose of controlling discharge gas resistance, mechanical strength, scratch resistance, viscosity and wear rate, reducing torque and prolonging pot life. Examples of the resin soluble in an alcohol solvent include polyvinyl butyral resin, polyvinyl formal resin, polyvinyl acetal resin such as partly acetalated polyvinyl acetal resin obtained by partly modifying butyral with formal, acetacetal or the like (e.g., S-LEC B, K, produced by SEKISUI CHEMICAL CO., LTD.), polyamide resin, cellulose resin, and phenol resin. Particularly preferred among these resins is polyvinyl acetal resin from the standpoint of electrical properties. The average molecular weight of the resin is preferably from 2,000 to 100,000, more preferably from 5,000 to 50,000. When the molecular weight of the resin falls below 2,000, the effect of the resin tends to be insufficient. On the contrary, when the molecular weight of the resin exceeds 100,000, the resulting resin exhibits a deteriorated solubility, restricting the amount thereof to be incorporated in the protective layer and causing the occurrence of defective film making during coating. The amount of the resin to be added is preferably from 1 to 40% by weight, more preferably from 1 to 30% by weight, even more preferably from 5 to 20% by weight. When the added amount of the resin falls below 1% by weight, the effect of the resin tends to be insufficient. On the contrary, when the added amount of the resin exceeds 40% by weight, image blurring can easily occur at high temperature and humidity.

The preparation of the surface layer coating solution containing these components may be effected free of solvent or optionally in the presence of an alcohol such as methanol, ethanol, propanol and butanol, ketone such as acetone and methyl ethyl ketone or solvent such as tetrahydrofurane, diethyl ether and dioxane. These solvents may be used singly or in admixture of two or more thereof. Preferably, a solvent having a boiling point of not higher than 100° C. is used. The amount of the solvent to be used may be arbitrarily predetermined. When the amount of the solvent is too small, the compound represented by the general formula (2) can easily be precipitated. Therefore, the amount of the solvent to be used is from 0.5 to 30 parts by weight, preferably from 1 to 20 parts by weight based on 1 part by weight of the compound represented by the general formula (2).

The reaction temperature at which the aforementioned components are reacted to obtain the desired siloxane-based resin varies with the kind of the raw material but preferably from −20° C. to 100° C., more preferably from −10° C. to 70° C., even more preferably from 0° C. to 50° C. The reaction time is preferably from 10 minutes to 100 hours because when it is too long, gelation can easily occur.

Examples of the curing catalyst in the presence of which the aforementioned components are reacted to obtain the desired siloxane-based resin include protonic acids such as hydrochloric acid, acetic acid, malic acid and sulfuric acid, bases such as ammonia and triethylamine, organic tin compounds such as dibutyltin diacetate, dibutyltin dioctoate and stannous octoate, organic titanium compounds such as tetra-n-butyl titanate and tetraisopropyl titanate, organic aluminum compounds such as aluminum tributoxide and aluminum triacetyl acetonate, and manganese salt, cobalt salt, zinc salt and zirconium salt of carboxylic acid. Preferred among these curing catalysts are metal compounds such as organic tin compound, organic titanium compound, organic aluminum compound and metal salt of carboxylic acid from the standpoint of storage stability. Even more desirable among these curing catalysts are acetyl acetonate and acetyl acetate of metal, particularly aluminum triacetyl acetonate. The amount of the curing catalyst to be used may be arbitrarily predetermined but is preferably from 0.1 to 20% by weight, more preferably from 0.3 to 10% by weight based on the total amount of the material containing a hydrolyzable silicon substituent ($-D-SiR_{3-a}Q_a$) from the standpoint of storage stability, properties, strength, etc. The curing temperature may be arbitrarily predetermined but is predetermined to be not lower than 60° C., more preferably not lower than 80° C. to obtain a desired strength. The curing time may be arbitrarily predetermined as necessary but is preferably from 10 minutes to 5 hours. It is also effective to keep the aforementioned components at high temperature and humidity after curing reaction for the purpose of stabilizing properties. The curing product may be subjected to surface treatment with hexamethyl disilazalane or trimethyl chlorosilane for hydrophobicization depending on the purpose.

The protective layer 16 preferably comprises an oxidation inhibitor incorporated therein for the purpose of inhibiting the deterioration thereof by an oxidizing gas such as ozone produced by the charging device. When the mechanical strength of the surface of the electrophotographic photoreceptor is enhanced to prolong the life of the electrophotographic photoreceptor, the electrophotographic photoreceptor comes in contact with the oxidizing gas for a long period of time. Therefore, the protective layer is required to have a greater oxidation resistance than ever. As the oxidation inhibitor there is preferably used a hindered phenol or hindered amine-based oxidation inhibitor. Any known oxidation inhibitor such as organic sulfur-based oxidation inhibitor, phosphite-based oxidation inhibitor, dithiocarbamate-based oxidation inhibitor, thiourea-based oxidation inhibitor and benzimidazole-based oxidation inhibitor may be used. The amount of the oxidation inhibitor to be added is preferably not greater than 20% by weight, more preferably not greater than 10% by weight.

Examples of the hindered phenol-based oxidation inhibitor employable herein include 2,6-di-t-butyl-4-methylphenol, 2,5-di-t-butylhydroquinone, N,N'-hexamethylenebis(3,5-di-t-butyl-4-hydroxyhydrocinnamide, 3,5-di-t-butyl-4-hydroxy-benzylphosphonate-diethyl ester, 2,4-bis[(octylthio)methyl]-o-cresol, 2,6-di-t-butyl-4-ethylphenol, 2,2'-methylenebis'4-methyl-6-t-butylphenol), 2,2'-methylenebis(4-ethyl-6-t-butylphenol), 4,4'-butylidenebis(3-methyl-6-t-butylphenol), 2,5-di-t-amylhydroquinone, 2-t-butyl-6-(3-butyl-2-hydroxy-5-methylbenzyl)-4-methylphenyl acrylate, and 4,4'-butylidenebis(3-methyl-6-t-butylphenol).

The protective layer 16 may comprise various fine particulate materials incorporated therein to improve the contaminant attachment resistance and lubricating property of the surface of the electrophotographic photoreceptor. An example of the fine particulate material is a fine particulate silicon-containing material. The fine particulate silicon-containing material is a fine particulate material containing silicon as a constituent. Specific examples of the fine particulate silicon-containing material include colloidal silica, and fine particulate silicone. The colloidal silica to be used as fine particulate silicon-containing material is selected from the group consisting of dispersion of silica having an average particle diameter of from 1 to 100 nm, preferably from 10 to 30 nm in an acidic or alkaline aqueous dispersion and organic solvent such as alcohol, ketone and ester. As such a colloidal silica there may be used a product which is commercially available. The content of solid colloidal silica in the protective layer 16 is not specifically limited but is from 0.1 to 50% by weight, preferably from 0.1 to 30% by weight based on the total solid content of the protective layer 16 from the standpoint of film-making properties, electrical properties and strength.

The fine particulate silicone to be used as fine particulate silicon-containing material is selected from the group consisting of particulate silicone resin, particulate silicone rubber and particulate silicone-surface treated silica. As such a fine particulate silicone there may be used a product which is commercially available. The fine particulate silicone is spherical. The average particle diameter of the fine particulate silicone is preferably from 1 to 500 nm, more preferably from 10 to 100 nm. Since the fine particulate silicone is a chemically inert fine particulate material having an excellent dispersibility in a resin and a small particle diameter and needs to be incorporated in the protective layer only in a small amount to obtain sufficient properties, the surface properties of the electrophotographic photoreceptor can be improved without inhibiting the crosslinking reaction. In other words, the lubricating property and water repellency of the surface of the electrophotographic photoreceptor can be enhanced while the surface of the electrophotographic photoreceptor is being uniformly taken in the rigid crosslinked structure, making it possible to maintain good abrasion resistance and resistance to attachment of contaminants over an extended period of time. The content of the fine particulate silicone in the protective layer 16 is preferably from 0.1 to 30% by weight, more preferably from 0.5 to 10% by weight based on the total solid content of the protective layer 16.

Examples of Q include fine particulate fluorine-based materials such as ethylene tetrafluoride, ethylene trifluoride, propylene hexafluoride, vinyl fluoride and vinylidene fluoride, fine particulate materials of resin obtained by the copolymerization of fluororesin with monomer having hydroxyl group as disclosed in "Preprint of 8th Polymer Material Forum", page 89, and semiconductor metal oxides such as $ZnO—Al_2O_3$, $SnO_2—Sb_2O_3$, $In_2O_3—SnO_2$, $ZnO_2—TiO_2$, $ZnO—TiO_2$, $MgO—Al_2O_3$, $FeO—TiO_2$, $SnO_2$, $In_2O_3$, ZnO and MgO. The protective layer may comprise an oil such as silicone oil incorporated therein for similar purposes. Examples of the silicone oil employable herein include silicone oils such as dimethyl polysiloxane, diphenyl polysiloxane and phenylmethyl siloxane, reactive silicone oils such as amino-modified polysiloxane, epoxy-modified polysiloxane, carboxyl-modified polysiloxane, carbinol-modified polysiloxane, methacryl-modified polysiloxane, carbinol-modified polysiloxane, methacryl-modified polysiloxane, mercapto-modified polysiloxane and phenol-modified polysiloxane, cyclic dimethyl cyclosiloxanes such as hexamethyl cyclotrisiloxane, octamethyl cyclotetrasiloxane, decamethyl cyclopentasiloxane and dodecamethyl cyclohexanesiloxane, cyclic methylphenyl cyclosiloxanes such as 1,3,5-trimethyl-1,3,5-triphenylcyclotrisiloxane, 1,3,5,7-tetramethyl-1,3,5,7-tetraphenylcyclotetrasiloxane and 1,3,5,7,9-pentamethyl-1,3,5,7,9-pentaphenylcyclopentasiloxane, cyclic phenyl cyclosiloxanes such as hexaphenyl cyclotrisiloxane, fluorine-containing cyclosiloxanes such as 3-(3,3,3-trifluoropropyl)methyl cyclotrisiloxane, hydrosilyl group-containing cyclosiloxanes such as methyl hydrosiloxane mixture, pentamethyl cyclopentasiloxane and phentylhydrocyclosiloxane, and vinyl group-containing cyclosiloxanes such as pentavinyl pentamethyl cyclopentasiloxane.

The siloxane-based resin having charge-transporting properties and a crosslinked structure has an excellent mechanical strength as well as sufficient photoelectric properties and thus may be used as the charge-transporting layer 15 of laminated photoreceptor as it is. In this case, an ordinary method such as blade coating method, meyer bar coating method, spray coating method, dip coating method, bead coating method, air knife coating method and curtain coating method may be employed. However, in the case where one time coating is not enough to obtain a required film thickness, the required film thickness can be obtained by coating by plural times. In the case where coating is effected by plural times, heat treatment may be effected every coating or after all the coating operations.

On the other hand, the charge-generating/charge-transporting layer 17 is formed with comprising a charge-generating material, a charge-transporting material and a binder resin incorporated therein. As these components there may be used the same components as exemplified with reference to the charge-generating layer 14 and the charge-transporting layer 15. In the case where the charge-generating/charge-transporting layer 17 is a surface layer as in the electrophotographic photoreceptor 1 shown in FIG. 5, the charge-generating/charge-transporting layer 17 contains as an essential component a siloxane-based resin having charge-transporting properties and a crosslinked structure.

The content of the charge-generating material in the charge-generating/charge-transporting layer 17 is from about 10 to 85% by weight, preferably from 20 to 50% by weight. The content of the charge-transporting material in the charge-generating/charge-transporting layer 17 is preferably from 5 to 50% by weight. The charge-generating/charge-transporting layer 17 may further comprise a compound represented by the general formula (2) incorporated therein. The formation of the charge-generating/charge-transporting layer 17 is accomplished by the same method as for the charge-generating layer 14 or the charge-transporting layer 15. The thickness of the charge-generating/charge-transporting layer 17 is preferably from about 5 to 50 μm, more preferably from 10 to 40 μm.

The various layers constituting the photosensitive layer 12 of the electrophotographic photoreceptor 1 shown in FIGS. 2 to 6 may comprise additives such as oxidation inhibitor, light stabilizer and heat stabilizer incorporated therein for the purpose of preventing the deterioration of the electrophotographic photoreceptor by ozone or oxidizing gas produced in the copying machine or light or heat. Examples of the oxidization inhibitor employable herein include hindered phenol, hindered amine, paraphenylene diamine, arylalkane, hydroquinone, spirochromane, spiroindanone, and derivative, organic sulfur compound and organic phosphorus compound thereof. Examples of the light stabilizer employable herein include derivatives such as benzophenone, benzotriazole, dithiocarbamate and tetramethyl piperidine. These layers may each further comprise at least one electron-accepting material incorporated therein for the purpose of enhancing sensitivity, lowering residual potential and reducing fatigue during repeated use. Examples of the electron-accepting material which can be incorporated in the photoreceptor of the invention include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranyl, dinitroanthraquinone, trinitrofluorenone, picric acid, o-nitrobenzoic acid, p-nitrobenzoic acid, phthalic acid, and compound represented by the general formula (2). Particularly preferred among these electron-accepting materials are fluorenone-based materials, quinone-based materials, and benzene derivatives having an electrophilic substituent such as Cl—, CN— and $NO_2$—.

Further, the surface layer of the electrophotographic photoreceptors shown in FIGS. 2 to 6 (e.g., charge-transporting layer 15, protective layer 16) may be treated with an aqueous dispersion containing a fluororesin as in the blade member to reduce the torque required for the rotation of the electrophotographic photoreceptor as well as enhance the transferring efficiency to advantage.

Cleaning Device

Figure 7:
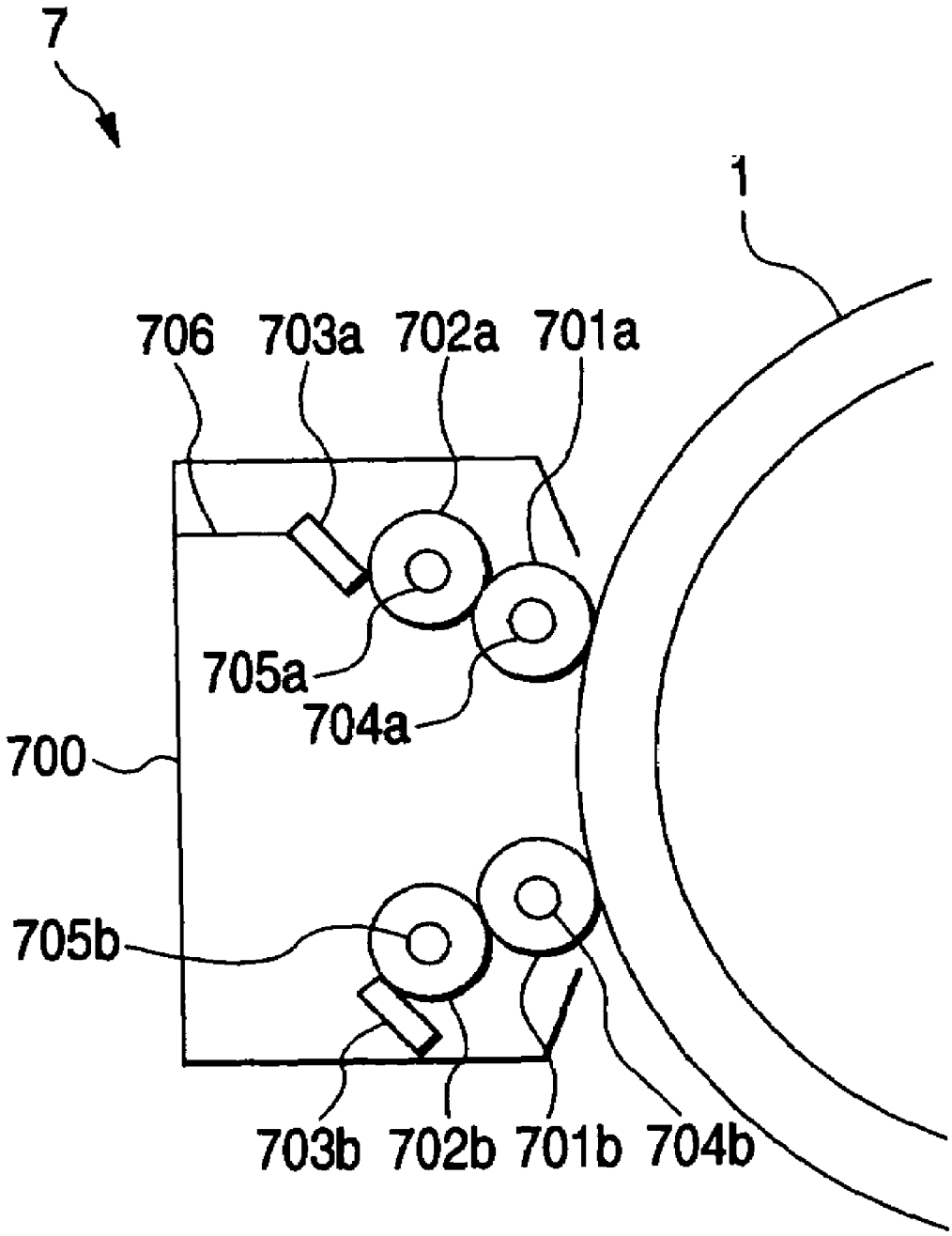
FIG. 7 is a schematic structural view illustrating an example of the cleaning device used in the invention.

FIG. 7 is a schematic structural view illustrating an example of the cleaning device to be used in the invention. The cleaning device 7 shown in FIG. 7 is of cartridge type and comprises two cleaning units. In some detail, in FIG. 7, a housing 700 receives a first cleaning unit comprising a roll-shaped brush member 701*a*, a recovery roll member 702*a* and a scraper 703*a* and a second cleaning unit comprising a roll-shaped brush member 701*b*, a recovery roll member 702*b* and a scraper 703*b*. The housing 700 is opened on the side thereof closer to the electrophotographic photoreceptor 1. At the opening, the periphery of the roll-shaped brush members 701*a* and 701*b* (surface formed by the leading end of brush) each come in contact with the periphery of the electrophotographic photoreceptor 1.

The roll-shaped brush member 701*a* (or 701*b*) comprises a plurality of fibers which are arranged on the periphery of a shaft 705*a* (or 705*b*) radially of the center of the shaft 705*a* to form a roll. The shafts 705*a* and 705*b* are each disposed parallel to a line tangential to the electrophotographic photoreceptor 1. The roll-shaped brush members 701*a* and 701*b* can rotate with rotational centers of the shafts 705*a* and 705*b*, respectively. The distance between the shafts 705*a* and 705*b* and the electrophotographic photoreceptor 1 is adjusted such that the intrusion depth, into the electrophotographic photoreceptor 1, of the leading end of the brush on the roll-shaped brush members 701*a* and 701*b* reaches a predetermined value (preferably from 0.5 to 2.0 mm, more preferably from 0.9 to 1.8 mm).

Examples of the fiber constituting the roll-shaped brush members 701*a* and 701*b* include fibers made of resin such as polyamide, polyacrylate, polyolefin and polyester. Commercially available products such as Beltron (produced by Kanebo, Ltd.), SA-7 (produced by Toray Industries, Inc.) and UU Nylon (produced by UNITIKA LTD:) may be used herein. The thickness of these fibers is preferably not greater than 30 denier, more preferably 20 denier, even more preferably from 2 to 10 denier. The density of these fibers is preferably not smaller than 20,000 fibers/inch$^2$, more preferably not smaller than 60,000 fibers/inch$^2$.

The recovery roll members 702*a* and 702*b* are obtained by curing a thermosetting resin into a roll form, and then arranging the roll on the periphery of the shafts 705*a* and 705*b*, respectively. The periphery of the recovery roll member 702*a* (or 702*b*) comes in contact with the leading end of brush of the brush member 701*a* (or 701*b*). The shaft 705*a* (or 705*b*) is disposed parallel to the shaft 704*a* (or 704*b*). The recovery roll member 702*a* (or 702*b*) can rotate with the shaft 705*a* (or 705*b*) as a rotational axis.

Examples of the thermosetting resin to be used for the recovery roll members 702*a* and 702*b* include phenolic resin, urea resin, melamine resin, unsaturated polyester, epoxy resin, and polyimide resin. Preferred among these thermosetting resins is phenolic resin because it has a high dimensional precision, can easily be formed, exhibits an excellent surface lubricating property in the form of formed product and is inexpensive.

The flexural modulus of the recovery roll members. 702*a* and 702*b* is preferably not smaller than 700 kPa. When the flexural modulus of the recovery roll members 702*a* and 702*b* falls below 700 kPa, the resulting recovery roll members undergo deflection, making it difficult to keep the contact point thereof with the brush member or blade member or the intrusion depth by the brush member or blade member at a predetermined value. When the thickness of the recovery roll members made of a material having a flexural modulus of less than 700 kPa is raised in an attempt to keep the desired rigidity of the recovery roll members, the resulting recovery roll members undergo raised molding shrinkage that gives an insufficient dimensional precision, are subject to increase of weight and prolongation of molding time and require post-treatment steps, causing cost rise. The term "flexural modulus" as used herein is meant to indicate a value measured according to JIS K7203.

Since the recovery roll members 702*a* and 702*b* are kept in contact with the roll-shaped brush members 701*a* and 701*b* and the blade members 703*a* and 703*b*, respectively, their operation cause the periphery of the recovery roll members 702*a* and 702*b* to be abraded. In the invention, the periphery of the recovery roll members preferably exhibits an abrasion of not greater than 20 mg as measured according to JIS K6902. In this arrangement, the contact pressure of the brush member and the blade member and the intrusion depth by the brush member and the blade member can be predetermined to be great values. Even under these conditions, stable cleaning can be performed over an extended period of time. When the abrasion exceeds 20 mg, the resulting recovery roll members exhibit an insufficient life that requires frequent replacement.

The Rockwell hardness (M scale) of the recovery roll members 702*a* and 702*b* is preferably not smaller than 100. When the Rockwell hardness of the recovery roll members is not smaller than 100, molding can be effected with a high dimensional precision. Further, the resulting roll members are extremely resistant to scraping. The term "Rockwell hardness" as used herein is meant to indicate a value measured according to JIS K7202.

The scrapers 703*a* and 703*b* are made of a thin metal sheet. The scrapers 703*a* and 703*b* are disposed in contact with the periphery of the recovery roll members 702*a* and 702*b*, respectively, at one edge thereof. The scrapers 703*a* and 703*b* are each fixed to the housing 700 at the other end thereof. The method for fixing these scrapers to the housing is not specifically limited. Fixing may be made with a fixing metal 706 as in the case of scraper 703*a*. Alternatively, the scraper may be directly fixed to the housing 700 as in the case of 703*b*.

The scrapers 703*a* and 703*b* are preferably made of stainless steel or phosphor bronze from the standpoint of enhancement of durability and reduction of cost. The thickness of the scrapers 703*a* and 703*b* is preferably from 0.02 to 2 mm, more preferably from 0.05 to 1 mm. A blade member may be used instead of scraper.

In the cleaning device 7 having the aforementioned arrangement, the toner left on the electrophotographic photoreceptor 1 after transferring step (residual toner) is removed by the roll-shaped brush members 701*a* and 701*b*. Subsequently, the rotation of the roll-shaped brush members 701*a* and 701*b* causes the residual toner to be moved to the contact point with the recovery roll members 702*a* and 702*b*. In this manner, the leading end of brush of the roll-shaped brush members 701*a* and 701*b* is regenerated for repeated use in cleaning of the electrophotographic photoreceptor 1. The rotation of the recovery roll members 702*a* and 702*b* causes the residual toner attached to the recovery roll members 702*a* and 702*b* to be moved to the contact point with the scrapers 703*a* and 703*b* at which it is then removed by the scrapers 702*a* and 702*b*. In this manner, the surface of the recovery roll members 702*a* and 702*b*, too, can be regenerated for repeated use in the regeneration of the leading end of brush of the roll-shaped brush members.

In order to allow a fine powder such as toner and paper dust to be electrostatically adsorbed to the members and move along the surface of the members efficiently, a mechanism is preferably given that a cleaning bias having a potential different therefrom is applied across the roll-shaped brush member 701*a* (or 701*b*) and the recovery roll member 702*a* (or 702*b*). In some detail, by applying a predetermined voltage to the roll-shaped brush member 701*a* (or 701*b*), the resulting electrostatic attraction force allows the residual toner on the electrophotographic photoreceptor 1 to be attached to the roll-shaped brush member 701*a* (or 701*b*). By applying a voltage having the same polarity as that of the voltage applied to the brush member 701*a* (or 701*b*) but having a greater absolute value than that of the voltage applied to the brush member 701*a* (or 701*b*), the residual toner attached to the brush member 701*a* (or 701*b*) can be attached to the recovery roll member 702*a* (or 702*b*). The difference in potential between the roll-shaped brush member and the recovery roll member (absolute value) is preferably not smaller than 100 V, more preferably not smaller than 200 V, even more preferably 650 V.

In the case where a voltage is applied to the roll-shaped brush members 701*a* and 701*b*, the provision of the fibers of the brush members with electrical conductivity is accomplished by a method involving the incorporation of electrically-conductive powder or ionically-conductive material in the fibers, a method involving the formation of an electrically-conductive layer inside or outside the fibers or the like. The resistivity of the fibers thus rendered electrically conductive is preferably from $10^2$ to $10^9$ Ω·cm per fiber.

The adjustment of the electrical resistivity of the recovery roll members 702*a* and 702*b* is accomplished by a method involving the filling of an inorganic filler and/or organic filler. When an inorganic filler or organic filler is filled in the recovery roll member, the recovery roll member exhibits a raised rigidity to advantage. Examples of the inorganic filler employable herein include powder of metal such as tin, iron, copper and aluminum, metallic fiber, and glass fiber. Examples of the organic filler employable herein include carbon black, carbon powder, graphite, magnetic powder, metal oxide such as zinc oxide, tin oxide and titanium oxide, metal sulfide such as copper sulfide and zinc sulfide, so-called hard ferrite such as strontium, barium and rare earth, ferrite such as magnetite, copper, zinc, nickel and manganese, material obtained by electrically conducting the surface thereof as necessary, solid solution of metal oxide, i.e., so-called composite metal oxide obtained by calcining one selected from the group consisting of oxide, hydroxide, carbonate and metal compound containing different metal elements such as copper, iron, manganese, nickel, zinc, cobalt, barium, aluminum, tin, lithium, magnesium, silicon and phosphorus at high temperature, and polyaniline.

The resistivity of the recovery roll members 702*a* and 702*b* to which a voltage of 500 V is applied is preferably from $1\times10^5$ to $1\times10^{10}$ Ω·cm, more preferably from $1\times10^6$ to $1\times10^8$ Ω·cm. When the resistivity of the recovery roll members falls below $1\times10^5$ Ω·cm, charge is injected into the recovery roll members to reverse the polarity of fine powders such as toner and paper dust scraped by the brush member, making it difficult to electrostatically adsorb the finer powder. On the contrary, when the electrical resistivity of the recovery roll members exceeds $1\times10^{10}$ Ω·cm, a phenomenon of accumulation of charge (charge-up) on the recovery roll members can easily occur, similarly making it difficult to electrostatically adsorb the fine powder such as toner and paper dust.

The cleaning device shown in FIG. 7 has two cleaning units comprising a roll-shaped brush member, a recovery roll member and a blade member. In the invention, however, the number of such cleaning units is not specifically limited. For example, a cleaning device having one cleaning unit may be used. However, the cleaning device having a plurality of cleaning units as shown in FIG. 7 has the following advantages.

In other words, the polarity of the toner left on the electrophotographic photoreceptor 1 after transferring step (residual toner) can be easily dispersed by the effect of the transferring electric field. To be short, the majority of the residual toner is kept with positive polarity (originally charged polarity), but the polarity of some of the residual toner is reversed. In this case, by charging the cleaning unit comprising the roll-shaped brush member 701*a*, the recovery roll member 702*a* and the scraper 703*a* and the cleaning unit comprising the roll-shaped brush member 701*b*, the recovery roll member 702*b* and the scraper 703*b* to opposite polarities so that one of the two cleaning units is used for positive residual toner and the other is used for negative residual toner, both the positive and negative residual toners can be efficiently removed. More specifically, in the second cleaning unit, by applying a cleaning bias having a polarity different from that of the toner to the brush member 701*b* and the recovery roll member 702*b*, the positively charged toner, which accounts for the majority of the residual toner, is electrostatically adsorbed and moved. Subsequently, in the first cleaning unit, by applying a cleaning bias having the same polarity as that of the toner to the brush member 701*a* and the recovery roll member 702*a*, the negatively charged toner can effectively be electrostatically adsorbed and moved.

In the image forming apparatus shown in FIG. 1, the elements other than the electrophotographic photoreceptor 1 and the cleaning device 7 are not specifically limited, but preferred examples of these elements will be described below.

Charging Unit

The charging unit 2 is a triboelectric charging unit comprising a charging roll. In the case where triboelectric charging is effected, the electrophotographic photoreceptor 1 is much stressed. The image forming apparatus shown in FIG. 6 comprises an electrophotographic photoreceptor provided with a protective layer 16 and thus can exhibit an excellent durability which has heretofore been difficult to attain. The triboelectric charging unit may be replaced by a non-contact charging unit using corotron or scorotron which has heretofore been known.

Exposing Unit

As the exposing unit 3 there may be used an optical unit which can imagewise expose the surface of the electrophotographic photoreceptor 1 to light from a light source having a wavelength between 350 nm and 900 nm such as semiconductor laser, LED (light emitting diode) and liquid crystal shutter. Among these optical units, an exposing unit capable of exposing the electrophotographic photoreceptor to noninterference light can be used to prevent the occurrence of fringe across the support (substrate) and the photosensitive layer of the electrophotographic photoreceptor 1.

Developing Unit

As the developing unit 4 there may be used a known developing unit comprising a one-component or two-component normal or reversal developing agent. The form of the toner to be used is not specifically limited. For example, an amorphous toner obtained by grinding method or a spherical toner obtained by chemical polymerization method can be preferably used.

In the image forming apparatus of the invention, the electrophotographic photoreceptor 1 can be subjected to electrophotographic process having not smaller than 200,000 cycles (preferably not smaller than 250,000 cycles, more preferably not smaller than 300,000 cycles). Therefore, the image forming apparatus preferably has a mechanism capable of supplying a toner alone.

In the image forming apparatus of the invention, even when a toner having an average shape factor of from 115 to 140 is used, a phenomenon involving the passage of the toner between the gap between the electrophotographic photoreceptor and the brush member of the cleaning device can be prevented. Accordingly, the use of such a toner makes it possible to obtain a high quality image without impairing the cleaning properties.

The toner having an average shape factor of from 115 to 140 can be obtained by a kneading/grinding method which comprises kneading, grinding and classifying a binder resin, a coloring agent, a releasing agent and optionally a charge control agent, a method which comprises applying a mechanical impact or heat energy to particles obtained by a kneading/grinding method to change the shape thereof, an emulsion polymerization agglomeration method which comprises subjecting a polymerizable monomer of binder resin to emulsion polymerization to form a dispersion, mixing the dispersion, a coloring agent, a releasing agent and optionally a dispersion of charge control agent or the like, agglomerating the mixture, and then subjecting the mixture to heat fusion to obtain a particulate toner, a suspension polymerization method which comprises subjecting a polymerizable monomer from which a binder resin is obtained, a coloring agent, a releasing agent and optionally a solution of charge control agent or the like to suspension polymerization in an aqueous solvent, a solution suspension method which comprises suspending a binder resin, a coloring agent, a releasing agent and optionally a solution of charge control agent or the like in an aqueous solvent to cause granulation or the like. Alternatively, a preparation method can be used which comprises attaching agglomerated particles to the toner thus obtained as a core, and then subjecting the toner to heat fusion to provide the toner with a core-shell structure. Preferred among these preparation methods are suspension polymerization method, emulsion polymerization agglomeration method and solution suspension method effected in an aqueous solvent from the standpoint of control over shape and distribution of particle sizes. Particularly preferred among these preparation methods is emulsion polymerization agglomeration method. The toner matrix comprises a binder resin, a coloring agent and a releasing agent, and optionally silica or a charge control agent. The average particle diameter of the toner is from 1 to 12 μm, preferably from 3 to 9 μm.

Examples of the binder resin to be incorporated in the toner include homopolymers and copolymers of styrenes such as styrene and chlorostyrene, monoolefins such as ethylene, propylene, butylene and isoprene, vinyl esters such as vinyl acetate, vinyl propionate, vinyl benzoate and vinyl butyrate, α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate, vinyl ethers such as vinyl methyl ether, vinyl ethyl ether and vinyl butyl ether and vinyl ketones such as vinyl methyl ketone, vinyl hexyl ketone and vinyl isopropenyl ketone. Particularly representative examples of binder resin include polystyrene, styrene-alkyl acrylate copolymer, styrene-alkyl methacrylate copolymer, styrene-acrylonitrile copolymer, styrene-butadiene copolymer, styrene-maleic anhydride copolymer, polyethylene, polypropylene, polyester, polyurethane, epoxy resin, silicone resin, polyamide, modified rosin, and paraffin wax.

Representative examples of the coloring agent for toner include magnetic powder such as magnetite and ferrite, carbon black, aniline blue, chalil blue, Chrome Yellow, ultramarine blue, Du Pont blue, Du Pont oil red, quinoline yellow, methylene blue chloride, phthalocyanine blue, malachite green oxalate, lamp black, rose bengal, C.I. pigment red 48:1, C.I. pigment red 122, C.I. pigment red 57:1, C.I. pigment yellow 97, C.I. pigment yellow 17, C.I. pigment blue 15:1, and C.I. pigment blue 15:3.

Representative examples of the releasing agent employable herein include low molecular polyethylene, low molecular polypropylene, Fischer-Tropsch wax, montan wax, carnauba wax, rice wax, and candelilla wax.

The toner may further comprise a charge control agent incorporated therein as necessary. As the charge control agent there may be used any known charge control agent. An azo-based metal complex compound, a metal complex compound of salicylic acid, and a resin type charge control agent containing a polar group can be used. In the case where a wet process is used to prepare a toner, a material which can be difficultly dissolved in water is preferably used from the standpoint of control over ionic strength and reduction of contamination of waste liquid. The toner for use in the invention may be either a magnetic toner containing a magnetic material or a non-magnetic toner free of magnetic material.

The toner to be used in the invention can be prepared by blending the aforementioned particulate toner and the aforementioned external additives using a Henschel mixer, V-blender or the like. In the case where a wet process is used to prepare a particulate toner, external addition may be effected in a wet process.

As lubricating particles to be incorporated in the toner of the invention there may be used solid lubricants such as graphite, molybdenum disulfide, talc, aliphatic acid and metal salt of aliphatic acid, low molecular polyolefins such as polypropylene, polyethylene and polybutene, silicones which exhibit a softening point upon heating, aliphatic amides such as amide oleate, erucamide, amide ricinoleate and amide stearate, vegetable waxes such as carnauba wax, rice wax, candelilla wax, wood wax and jojoba oil, animal waxes such as beeswax, mineral and petroleum waxes such as montan wax, ozokerite, seresin, paraffin wax, microcrystalline wax and Fischer-Tropsch wax, and modification products thereof, singly or in combination. Referring to the average particle diameter of the lubricating particles, the materials having the aforementioned chemical structures may be ground to a uniform particle diameter of from 0.1 to 10 μm. The amount of the particulate active material to be incorporated in the toner is preferably from 0.05 to 2.0% by weight, more preferably from 0.1 to 1.5% by weight.

The toner of the invention may further comprise an inorganic particulate material such as aluminum oxide, cerium oxide and barium sulfate incorporated therein for the purpose of removing matters attached to the surface of the electrophotographic photoreceptor 1 and deteriorated matters. Preferred among these inorganic particulate materials is cerium oxide. The average particle diameter of these inorganic particulate materials is preferably from 0.1 to 3.0 μm, more preferably from 0.1 to 2.0 μm. The amount of the inorganic particulate material, if incorporated in the toner, is preferably greater than that of the lubricating particles. The sum of the added amount of the inorganic particulate material and the lubricating particles is preferably not smaller than 0.6% by weight.

By predetermining the added amount of inorganic particulate material and lubricating particles to the aforementioned preferred range, the desired cleaning properties with respect to discharge products and cleaning properties with the toner having an average shape factor of from 115 to 140 can be attained at the same time.

The toner of the invention preferably comprises a small diameter inorganic oxide having a primary particle diameter of not greater than 40 nm incorporated therein for the purpose of controlling the powder fluidity and chargeability thereof, and further comprises an inorganic oxide having a greater diameter than the aforementioned small diameter inorganic oxide incorporated therein for the purpose of reducing adhesion or controlling chargeability. As these fine particulate inorganic oxides there may be used any known such materials. Silica and titanium oxide are preferably used in combination to effect precision charge control. The small diameter inorganic oxide can be subjected to surface treatment to have a raised dispersibility and hence a raised powder fluidity.

The electrophotographic color toner may be used in admixture with a carrier. As such a carrier there may be used an iron powder, glass bead, ferrite powder, nickel powder or material obtained by coating such a powder with a resin. The mixing proportion of the color toner and the carrier can be properly predetermined.

Transferring Unit

Examples of the transferring unit 5 employable herein include contact type transferring charger comprising belt, roller, film, rubber blade or the like, and scorotron transferring charger and corotron transferring charger utilizing corona discharge.

Image Fixing Unit

As the image fixing unit 6 there may be used one comprising an image fixing member such as roller.

Color Image Forming Apparatus

As another example of the image forming apparatus according to the present invention, a tandem type color image forming apparatus is described below.

Figure 8:
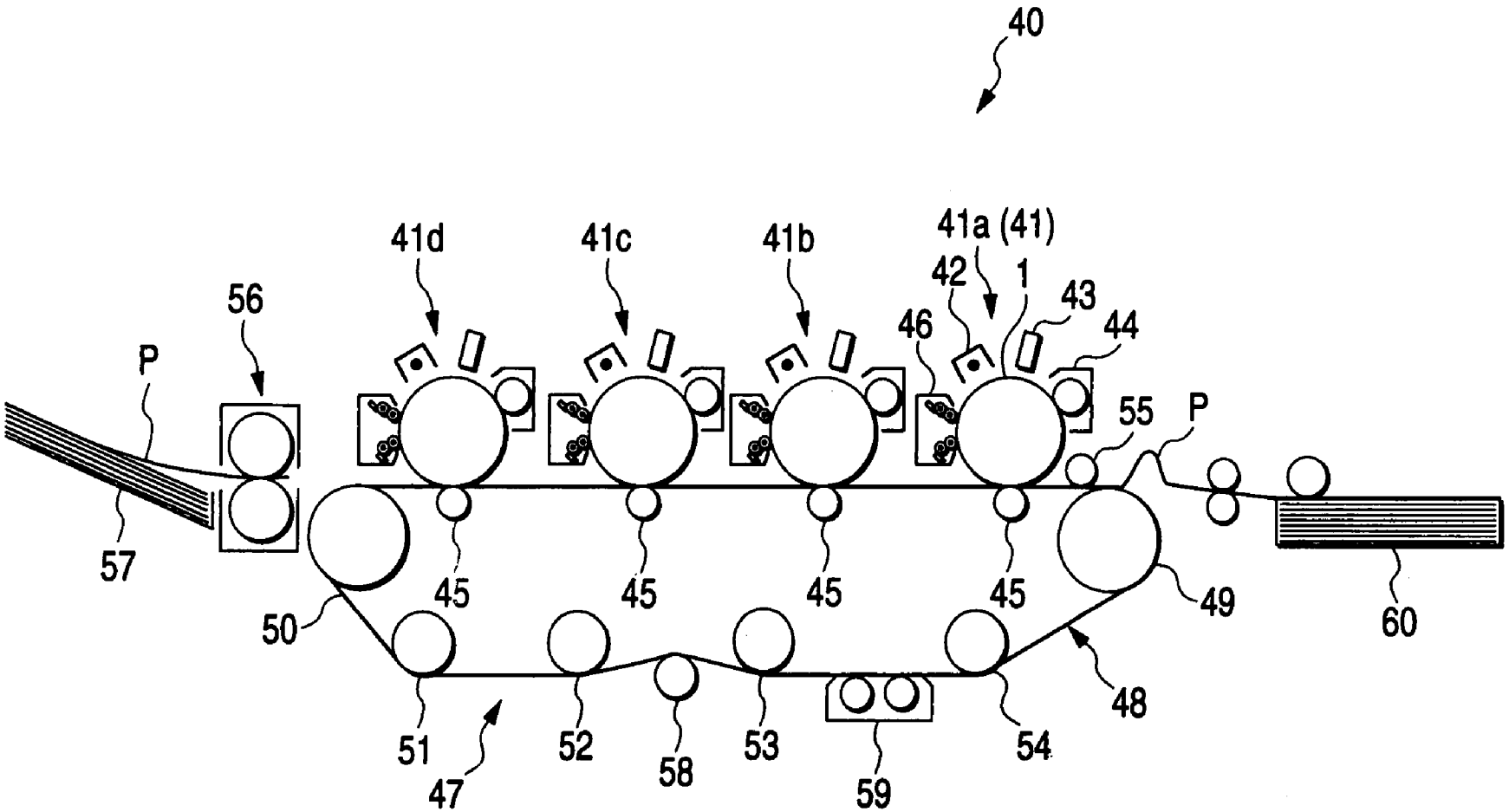
FIG. 8 is a schematic structural view illustrating an image forming apparatus according to the second embodiment of the invention.

FIG. 8 is a side view schematically illustrating an image forming apparatus according to the second embodiment of the invention. As shown in FIG. 8, the image forming apparatus 40 according to the present embodiment is a so-called tandem type color image forming apparatus comprising four image forming units 41 (41*a* to 41*d*).

As shown in FIG. 8, the aforementioned image forming units 41 each comprise an electrophotographic photoreceptor 1, a charging unit 42 for charging the surface of the electrophotographic photoreceptor 1, an exposing unit 43 for exposing the electrophotographic photoreceptor 1 charged by the charging unit 42 to light to form an electrostatic latent image, a developing unit 44 for developing the electrostatic latent image formed by the exposing unit 43 with a toner, a transferring unit 45 for transferring the toner image developed on the electrophotographic photoreceptor 1 by the developing unit 44 onto a transferring medium P, and a cleaning device 46 for cleaning the surface of the electrophotographic photoreceptor from which the image has been transferred onto the transferring medium P by the transferring unit 45. The electrophotographic photoreceptor 1 and the cleaning devices 46*a* to 46*d* in the image forming units 41*a* to 41*d* have the same structure as that of the electrophotographic photoreceptor 1 and the cleaning device 7 of the image forming apparatus shown in FIG. 1, respectively.

The image forming units 41*a* to 41*d* are adapted to form different color images. The developing unit in the various image forming units 41*a* to 41*d* employ different color toners.

The image forming apparatus 40 comprises a belt conveyor unit 47 disposed opposed to the image forming unit 41 for conveying a recording material P and a recording material supplying unit 60 for supplying the recording material P into the belt conveying unit 41. The belt conveying unit 47 has an endless conveying belt 48 which is hung on six suspension rolls 49 to 54 and four transferring units 45. When the recording material P is supplied into the belt conveying unit 47 by the recording material supplying unit 60 while the conveying belt 48 is being circulated, the recording material P is adsorbed to and retained on the conveying belt 48 by the adsorption roll 55 and then moved to the transferring site in the various image forming units 41*a* to 41*d* in sequence. The recording material P which has passed through the four image forming units 41*a* to 41*d* to have a color image transferred thereon has the color toner image fixed by a fixing unit 56, and is then received by a receiving tray 57. The reference numeral 58 indicates a tension roll for providing the conveying belt 48 with a predetermined tension. The reference numeral 59 indicates a belt cleaner for cleaning the surface of the conveying belt 48.

As mentioned above, in the image forming units 41*a* to 41*d* according to the second embodiment, the arrangement of the electrophotographic photoreceptor 1 comprising a surface layer 16 containing a siloxane-based resin having charge-transporting properties and a crosslinked structure and the cleaning devices having a roll-shaped brush member and the predetermination of the product ($R_z \times W_e$) of the surface roughness ($R_z$ [μm]) of the electrophotographic photoreceptor after 200,000 rotations thereof and the wear rate of the electrophotographic photoreceptor per 1,000 rotations ($W_e$ [nm]) to be not greater than 20 make it sure to remove residual toner without causing phenomena such as damage on the surface of the electrophotographic photoreceptor 1, filming of the toner by agglomerated external additives and passage of toner. Accordingly, even color image forming apparatus can be provided with high operation speed, high performance and prolonged life.

The invention is not limited to the aforementioned embodiments. For example, the image forming apparatus of the invention may further comprise a destaticizer such as erase light irradiation apparatus. In this arrangement, in the case where the electrophotographic photoreceptor is repeatedly used, a phenomenon that the residual potential of the electrophotographic photoreceptor is carried over the subsequent cycle can be prevented, making it possible to further enhance image quality.

EXAMPLES

The invention will be illustrated in greater detail with reference to the following Examples and comparative Examples, but the invention should not be construed as being limited thereto.

Preparation of Electrophotographic Photoreceptor

Photoreceptor 1

A drawn tube (diameter: 84 mm; length: 357 mm) made of JIS A3003 alloy is prepared. The drawn tube is then polished by a centerless grinding machine to a surface roughness $R_z$ of 0.6 μm. Subsequently, the outer surface of the drawn tube is subjected to degreasing, etching with a 2% (by weight) solution of sodium hydroxide for 1 minute, neutralization and washing with purified water in sequence. Subsequently, the drawn tube thus treated is subjected to anodization, i.e., treated with a 10% (by weight) solution of sulfuric acid at a current density of 1.0 A/dm$^2$ to form an anodized film on the surface of the cylinder. After rinsed, the drawn tube is dipped in a 1% (by weight) solution of nickel acetate at 80° C. for 20 minutes to effect sealing. The drawn tube is then subjected to rinsing with purified water and drying. Thus, an anodized film is formed on the outer surface of the drawn tube to a thickness of 7 μm to obtain an electrically-conductive support.

Subsequently, 1 part by weight of chlorogallium phthalocyanine having a diffraction peak at a Bragg angle (2θ±0.2°) of 7.4°, 16.6°, 25.5° and 28.3° in X-ray diffraction spectrum is mixed with 1 part by weight of a polyvinyl butyral (S-LEC BM-S, produced by SEKISUI CHEMICAL CO., LTD.) and 100 parts by weight of n-butyl acetate. The mixture is then subjected to dispersion with glass beads in a paint shaker for 1 hour to prepare a charge-generating layer coating solution. The coating solution thus obtained is applied to the anodized film on the electrically conductive support by a dip coating method, and then heated and dried at a temperature of 100° C. for 10 minutes to form a charge-generating layer to a thickness of about 0.15 μm.

Subsequently, 2 parts by weight of a benzidine compound represented by the following general formula (29) and 3 parts by weight of a polymer compound having a repeating unit represented by the following general formula (30) (viscosity-average molecular weight: 39,000) are dissolved in 20 parts by weight of chlorobenzene to prepare a charge-transporting layer coating solution. The coating solution thus obtained is applied to the aforementioned charge-generating layer by a dip coating method, and then heated to a temperature of 110° C. for 40 minutes to form a charge-transporting layer to a thickness of 20 μm. Thus, a photoreceptor 1 is obtained.

(29)

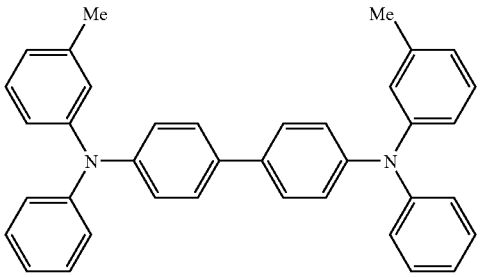

(30)

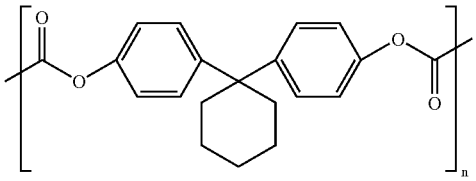

Subsequently, 2 parts by weight of a compound 2 represented by the following general formula (31), 2 parts by weight of methyl trimethoxysilane, 0.5 parts by weight of tetramethoxysilane and 0.3 parts by weight of a colloidal silica are dissolved in a mixture of 5 parts by weight of isopropyl alcohol, 3 parts by weight of tetrahydrofurane and 0.3 parts by weight of distilled water. To the solution are then added 0.5 parts by weight of an ion exchange resin (Amberlyst 15E). The mixture is then stirred at room temperature for 24 hours to undergo hydrolysis.

(31)

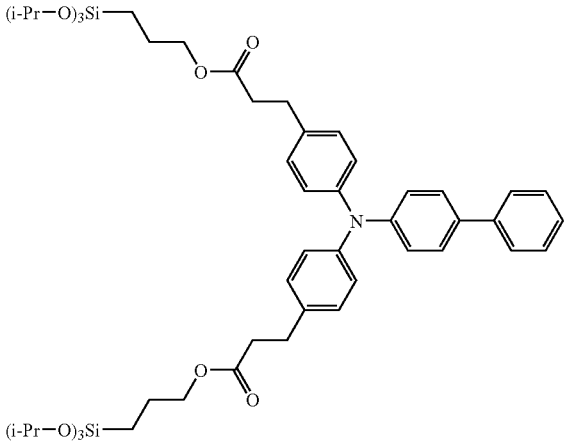

Subsequently, the reaction mixture obtained by hydrolysis is filtered to remove the ion exchange resin. To the filtrate are then added 0.1 parts by weight of aluminum trisacetatyl acetonate ($Al(aqaq)_3$) and 0.4 parts by weight of 3,5-di-t-butyl-4-hydroxytoluene (BHT) to prepare a protective layer coating solution. The coating solution thus prepared is applied to the charge-transporting layer by a ring dip coating method, air-dried at room temperature for 30 minutes, and then subjected to heat treatment at 170° C. for 1 hour to form a protective layer to a thickness of about 3 μm. Thus, a photoreceptor 1 is obtained.

Photoreceptor 2

A charge-transporting layer is formed in the same manner as for the photoreceptor 1.

Subsequently, 3 parts by weight of a compound 3 represented by the aforementioned general formula (31), 2 parts by weight of methyl trimethoxysilane, 0.5 parts by weight of tetramethoxysilane and 0.3 parts by weight of a colloidal silica are dissolved in a mixture of 5 parts by weight of isopropyl alcohol, 3 parts by weight of tetrahydrofurane and 0.3 parts by weight of distilled water. To the solution thus obtained are then added 0.5 parts by weight of an ion exchange resin (Amberlyst 15E). The mixture is then stirred at room temperature for 24 hours to undergo hydrolysis.

Subsequently, the reaction mixture obtained by hydrolysis is filtered to remove the ion exchange resin. To 5 parts by weight of the filtrate are then added 0.1 parts by weight of aluminum trisacetyl acetonate ($Al(acac)_3$), 0.4 parts by weight of 3,5-di-t-butyl-4-hydroxytoluene (BHT) and 0.5 parts by weight of a butyral resin (BX-L, produced by SEKISUI CHEMICAL CO., LTD.) to prepare a protective layer coating solution. The coating solution thus prepared is applied to the charge-transporting layer by a ring dip coating method, air-dried at room temperature for 30 minutes, and then subjected to heat treatment at 170° C. for 1 hour to form a protective layer to a thickness of about 3 μm. Thus, a photoreceptor 2 is obtained.

Photoreceptor 3

A photoreceptor 3 is prepared in the same manner as for the photoreceptor 1 except that no colloidal silica is used to prepare the protective layer coating solution.

Photoreceptor 4

A photoreceptor 4 is prepared in the same manner as for the photoreceptor 1 except that 2.5 parts by weight of a compound (III-8) set forth in Table 1 are used instead of 2 parts by weight of trimethoxysilane to prepare the protective layer coating solution.

Photoreceptor 5

A photoreceptor 5 is prepared in the same manner as for the photoreceptor 1 except that 2.5 parts by weight of a compound (III-13) set forth in Table 1 are used instead of 2 parts by weight of trimethoxysilane to prepare the protective layer coating solution.

Photoreceptor 6

A photoreceptor 6 is prepared in the same manner as for the photoreceptor 2 except that 2.5 parts by weight of a compound (III-13) set forth in Table 1 are used instead of 2 parts by weight of trimethoxysilane to prepare the protective layer coating solution.

Photoreceptor 7

A photoreceptor 7 is prepared in the same manner as for the photoreceptor 6 except that 2 parts by weight of a compound represented by the following general formula

(32) are used instead of 3 parts by weight of the compound represented by the foregoing general formula (31).

(32)

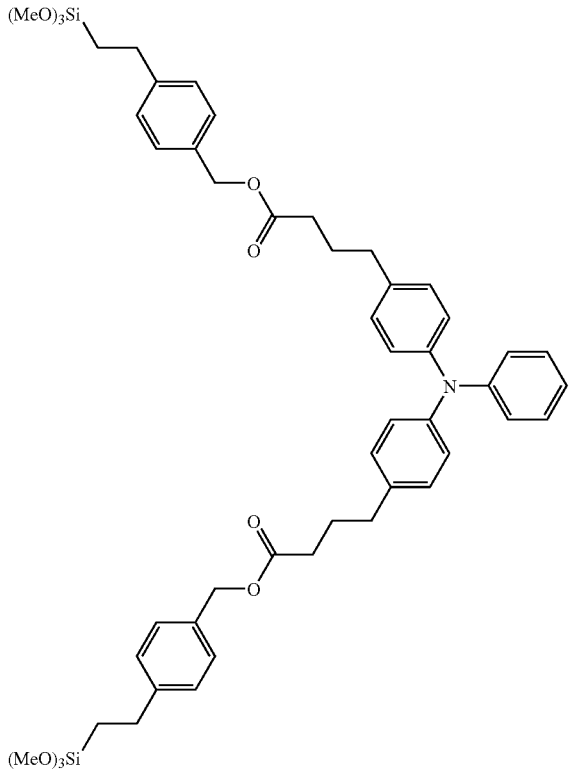

Photoreceptor 8

A photoreceptor 8 is prepared in the same manner as for the photoreceptor 6 except that 2 parts by weight of a compound represented by the following general formula (33) are used instead of 3 parts by weight of the compound represented by the foregoing general formula (31).

(33)

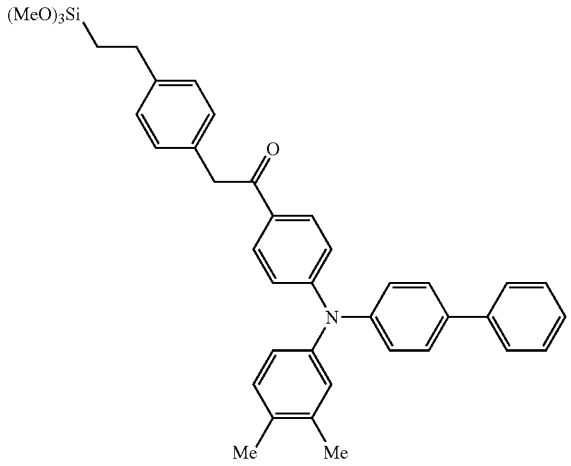

Photoreceptor 9

A photoreceptor 9 is prepared in the same manner as for the photoreceptor 6 except that 2 parts by weight of a compound represented by the following general formula (34) are used instead of 3 parts by weight of the compound represented by the foregoing general formula (31).

(34)

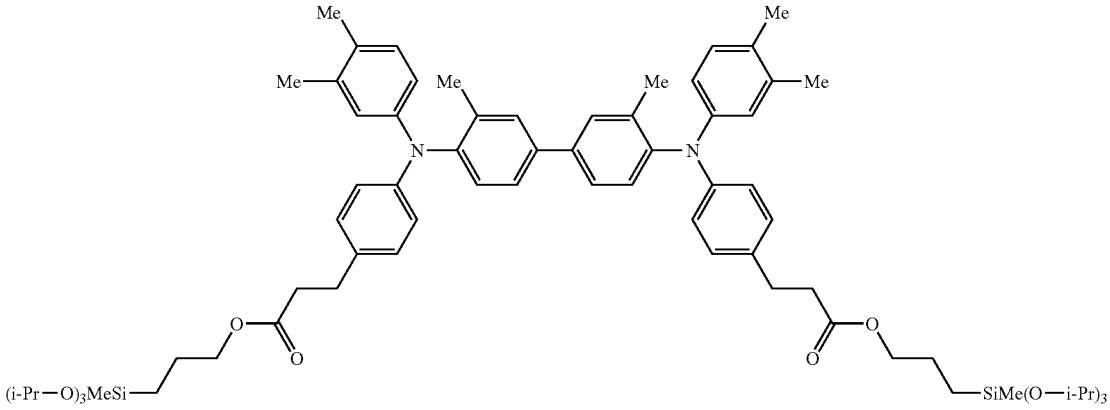

Photoreceptor 10

A photoreceptor 10 is prepared in the same manner as for the photoreceptor 5 except that 2 parts by weight of a compound represented by the following general formula (34) are used instead of 3 parts by weight of the compound represented by the foregoing general formula (31).

Photoreceptor 11

A charge-transporting layer is formed in the same manner as for the photoreceptor 1. A photoreceptor 11 is then prepared free of protective layer Preparation of Cleaning Device As first and second cleaning units there are used those described below, respectively, to prepare cleaning devices 1 to 3 (all are of process cartridge type) shown in FIG. 7. For comparison, a cleaning blade is used as a cleaning device 4.

Cleaning device 1

<First Cleaning Unit>

Roll-shaped Brush Member

Brush material: electrically-conductive nylon; fiber thickness: 2 denier (about 17 μm); electrical resistivity: $1\times10^5$ Ω; hair length: 4 mm; fiber density: 50,000 fibers/inch$^2$; intrusion depth into photoreceptor: about 1.5 mm; peripheral speed: 60 mm/s; direction of rotation: opposite that of photoreceptor; bias applied to brush: +200 V Recovery Roll Member Material; phenol resin having electrically-conductive carbon dispersed therein; electrical resistivity: $1\times10^6$ Ω; flexural modulus (JIS K7203): 100 MPa; abrasion (JIS K6902): 2 mg; Rockwell hardness (JIS K7202, M scale): 120: intrusion depth into brush material: 1.5 mm; peripheral speed: 70 mm/s: applied bias: +600 V Scraper Material: SUS304; thickness: 80 μm; intrusion depth into recovery roll member: 1.3 mm; free length: 8.0 mm <Second Cleaning Unit>

Roll-shaped Brush Member

Brush material: electrically-conductive nylon; fiber thickness: 2 denier (about 17 μm); electrical resistivity: $1\times10^5$ Ω; hair length: 4 mm; fiber density: 50,000 fibers/inch$^2$; intrusion depth into photoreceptor: about 1.5 mm; peripheral speed: 60 mm/s; direction of rotation: opposite that of photoreceptor; bias applied to brush: −200 V Recovery Roll Member Material: phenol resin having electrically-conductive carbon dispersed therein; electrical resistivity: $1\times10^6$ Ω; flexural modulus (JIS K7203): 100 MPa; abrasion (JIS K6902): 2 mg; Rockwell hardness (JIS K7202, M scale): 120; intrusion depth into brush material: 1.5 mm; peripheral speed: 70 mm/s; applied bias: −800 V Scraper Material: SUS304; thickness: 80 μm; intrusion depth into recovery roll member: 1.3 mm; free length: 8.0 mm.

Cleaning Device 2

<First Cleaning Unit>

Roll-shaped Brush Member

Brush material: electrically-conductive nylon; fiber thickness: 5 denier (about 43 μm): electrical resistivity: $1\times10^5$ Ω; hair length: 4 mm; fiber density: 150,000 fibers/inch$^2$; intrusion depth into photoreceptor: about 1.5 mm; peripheral speed: 60 mm/s; direction of rotation: opposite that of photoreceptor; bias applied to brush: +200 V Recovery Roll Member Material: phenol resin having electrically-conductive carbon dispersed therein; electrical resistivity: $1\times10^6$ Ω; flexural modulus (JIS K7203): 100 MPa; abrasion (JIS K6902): 2 mg; Rockwell hardness (JIS K7202, M scale): 120; intrusion depth into brush material: 1.5 mm; peripheral speed: 70 mm/s: applied bias: +600 V Scraper Material: SUS304; thickness: 80 μm; intrusion depth into recovery roll member: 1.3 mm; free length: 8.0 mm <Second Cleaning Unit>

Roll-shaped Brush Member

Brush material: electrically-conductive nylon; fiber thickness: 5 denier (about 43 μm); electrical resistivity: $1\times10^5$ Ω; hair length: 4 mm; fiber density: 150,000 fibers/inch$^2$; intrusion depth into photoreceptor: about 1.5 mm; peripheral speed; 60 mm/s; direction of rotation: opposite that of photoreceptor; bias applied to brush: −400 V Recovery Roll Member Material: phenol resin having electrically-conductive carbon dispersed therein; electrical resistivity: $1\times10^6$ Ω; flexural modulus (JIS K7203): 100 MPa; abrasion (JIS K6902): 2 mg; Rockwell hardness (JIS K7202, M scale): 120; intrusion depth into brush material: 1.5 mm; peripheral speed: 70 mm/s; applied bias: −800 V Scraper Material: SUS304; thickness: 80 μm; intrusion depth into recovery roll member: 1.3 mm; free length: 8.0 mm Cleaning Device 3

<First Cleaning Unit>

Roll-shaped Brush Member

Brush material: electrically-conductive nylon; fiber thickness: 20 denier (about 170 μm); electrical resistivity: $1\times10^5$ Ω; hair length: 4 mm; fiber density: 150,000 fibers/inch$^2$; intrusion depth into photoreceptor: about 1.5 mm; peripheral speed: 60 mm/s; direction of rotation: opposite that of photoreceptor; bias applied to brush: +200 V Recovery Roll Member Material: phenol resin having electrically-conductive carbon dispersed therein; electrical resistivity: $1\times10^6$ Ω; flexural modulus (JIS K7203): 100 MPa; abrasion (JIS K6902): 2 mg; Rockwell hardness (JIS K7202, M scale): 120; intrusion depth into brush material: 1.5 mm; peripheral speed: 70 mm/s; applied bias: +600 V Scraper Material: SUS304; thickness: 80 μm; intrusion depth into recovery roll member: 1.3 mm; free length: 8.0 mm <Second Cleaning Unit>

Roll-shaped Brush Member

Brush material: electrically-conductive nylon; fiber thickness: 20 denier (about 170 μm); electrical resistivity: $1\times10^5$ Ω; hair length: 4 mm: fiber density: 150,000 fibers/inch$^2$; intrusion depth into photoreceptor: about 1.5 mm; peripheral speed: 60 mm/s; direction of rotation: opposite that of photoreceptor; bias applied to brush: −400 V Recovery Roll Member Material: phenol resin having electrically-conductive carbon dispersed therein; electrical resistivity: $1\times10^6$ Ω; flexural modulus (JIS K7203): 100 MPa; abrasion (JIS K6902): 2 mg; Rockwell hardness (JIS K7202, M scale): 120; intrusion depth into brush material: 1.5 mm; peripheral speed: 70 mm/s; applied bias: −800 V Scraper Material: SUS304; thickness: 80 μm; intrusion depth into recovery roll member: 1.3 mm; free length: 8.0 mm Cleaning Device 4

Blade material: urethane rubber; thickness: 2 mm; intrusion depth into photoreceptor: 1.1 mm; free length: 10 mm; direction of orientation: doctor direction with respect to photoreceptor Preparation of Developing Agent In the following description, the various physical properties are measured as follows.

Distribution of Particle Sizes of Toner and Composite Particles

Using a multisizer (produced by Nikkaki-Bios Co., Ltd.), the distribution of particle sizes is measured at an aperture of 100 μm.

Average Shape Factor $ML^2/A$ of Toner and Composite Particles

The toner or composite particles are observed under an optical microscope. The image is taken in an image analyzer (LUXEXIII, produced by NIRECO Corporation) to measure the diameter of particle as calculated in terms of circle. Subsequently, the average shape factor $ML^2/A$ of the individual particles is determined from the maximum length and area of the toner particle or composite particles according to the following equation (1):

$$(ML^2/A)=(\text{Maximum length})^2\times\pi\times100/[4\times(\text{area})] \quad (1)$$

Developing Agent 1

Preparation of Toner Mother Particles

<Preparation of Dispersion of Fine Particulate Resin>

A solution obtained by mixing 370 g of styrene, 30 g of n-butyl acrylate, 8 g of acrylic acid, 24 g of dodecanethiol and 4 g of carbon tetrabromide and a solution obtained by dissolving 6 g of a nonionic surface active agent (Nonopole 400, produced by Sanyo Chemical Industries, Ltd.) and 10 g of an anionic surface active agent (Neogen SC, produced by DAIICHI SEIYAKU CO., LTD.) in 550 g of ion-exchanged water are mixed in a flask to initiate emulsion polymerization. To the mixture is then added 50 g of ion-exchanged water having 4 g of ammonium persulfate dissolved therein with mild stirring for 10 minutes. The air in the flask is then replaced by nitrogen. The mixture is then heated to a temperature of 70° C. over an oil bath with stirring. Emulsion polymerization continues for 5 hours. As a result, a dispersion of a fine particulate resin having an average particle diameter of 150 nm, a glass transition temperature (Tg) of 58° C. and a weight-average molecular weight ($M_w$) of 11,500 is obtained. The solid content concentration of the dispersion is 40% by weight.

<Preparation of Coloring Agent Dispersion>

60 g of a carbon black (Mogul L, produced by Cabot Corporation), 6 g of a nonionic surface active agent (Nonipole 400, produced by Sanyo Chemical Industries, Ltd.) and 240 g of ion-exchanged water are mixed with stirring by a homogenizer (Ultratalax T50, produced by IKA Japan K.K.) for 10 minutes. Thereafter, the mixture is subjected to dispersion by an altimizer to prepare a coloring agent dispersion 1 having a particulate coloring agent (carbon black) having an average particle diameter of 250 nm dispersed therein.

<Preparation of Coloring Agent Dispersion 2>

360 g of a cyan pigment (B15, produced by Dainichiseika Color & Chemicals Mfg. Co., Ltd.), 5 g of a nonionic surface active agent (Nonipole 400, produced by Sanyo Chemical Industries, Ltd.) and 240 g of ion-exchanged water are mixed with stirring by a homogenizer (Ultratalax T50, produced by IKA Japan K.K.) for 10 minutes. Thereafter, the mixture is subjected to dispersion by an altimizer to prepare a coloring agent dispersion 2 having a particulate coloring agent (cyan pigment) having an average particle diameter of 250 nm dispersed therein.

<Preparation of Coloring Agent Dispersion 3>

60 g of a magenta pigment (R122, produced by Dainichiseika Color & Chemicals Mfg. Co., Ltd.), 5 g of a nonionic surface active agent (Nonipole 400, produced by Sanyo Chemical Industries, Ltd.) and 240 g of ion-exchanged water are mixed with stirring by a homogenizer (Ultratalax T50, produced by IKA Japan K.K.) for 10 minutes. Thereafter, the mixture is subjected to dispersion by an altimizer to prepare a coloring agent dispersion 3 having a particulate coloring agent (magenta pigment) having an average particle diameter of 250 nm dispersed therein.

<Preparation of Coloring Agent Dispersion 4>

90 g of a yellow pigment (Y180, produced by Clariant Japan Co., Ltd.), 5 g of a nonionic surface active agent (Nonipole 400, produced by Sanyo Chemical Industries, Ltd.) and 240 g of ion-exchanged water are mixed with stirring by a homogenizer (Ultratalax T50, produced by IKA Japan K.K.) for 10 minutes. Thereafter, the mixture is subjected to dispersion by an altimizer to prepare a coloring agent dispersion 4 having a particulate coloring agent (yellow pigment) having an average particle diameter of 250 nm dispersed therein.

Yellow pigment Y180: 90 g

<Preparation of Releasing Agent Dispersion>

100 g of a paraffin wax (HNPO190, produced by NIPPON SEIRO CO., LTD., melting point: 85° C.), 5 g of a cationic surface active agent (SANISOL B50, produced by Kao Corp.) and 240 g of ion-exchanged water are mixed. The mixture is then subjected to dispersion in a round stainless steel flask using a homogenizer (Ultratalax T50, produced by IKA Japan K.K.) for 10 minutes. Thereafter, the mixture is subjected to dispersion by a pressure-ejecting homogenizer to prepare a releasing agent dispersion having a particulate releasing agent having an average particle diameter of 550 nm dispersed therein.

<Preparation of Toner Mother Particles K1>

234 parts by weight of the aforementioned dispersion of fine particulate resin, 30 parts by weight of the aforementioned coloring agent dispersion 1, 40 parts by weight of the releasing agent dispersion, 0.5 parts by weight of polyaluminum hydroxide (Paho 2S, produced by Asada Chemical Co., Ltd.), and 600 parts by weight of ion-exchanged water are put in a round stainless steel flask. Using a homogenizer (Ultratalax T50, produced by IKA Japan K.K.), the mixture is stirred and dispersed. Thereafter, the mixture is heated with stirring over a heating oil bath to a temperature of 40° C. where it is then kept for 30 minutes. During this procedure, it is confirmed that agglomerated particles having D50 of 4.5 μm have been produced in the mixture. The temperature of the heating oil bath is then raised to 56° C. where the mixture is then kept for 1 hour. As a result, D50 of the agglomerated particles is 5.3 μm. To the dispersion containing these agglomerated particles are then added 26 parts by weight of the dispersion of particle resin. The dispersion is then kept at a temperature of 50° C. over a heating oil bath for 30 minutes. To the dispersion of these agglomerated particles is then added 1N sodium hydroxide to adjust pH of the dispersion to 7.0. Thereafter, the flask is hermetically sealed. Using a magnetic seal, the dispersion is then heated to 80° C. with stirring for 4 hours. The dispersion is cooled, and then filtered to withdraw the toner mother particles produced during dispersion. The toner mother particles are washed with ion-exchanged water four times, and then freeze-dried to obtain toner mother particles K1. The toner mother particles K1 have D50 of 5.9 μm and an average shape factor $ML^2/A$ of 132.

<Preparation of Toner Mother Particles C1>

Toner mother particles C1 are prepared in the same manner as for the toner mother particles K1 except that the colored particle dispersion 2 is used instead of the colored particle dispersion 1. The toner mother particles C1 thus obtained have D50 of 5.8 μm and an average shape factor $ML^2/A$ of 131.

<Preparation of Toner Mother Particles M1>

Toner mother particles M1 are prepared in the same manner as for the toner mother particles K1 except that the colored particle dispersion 3 is used instead of the colored particle dispersion 1. The toner mother particles M1 thus obtained have D50 of 5.5 μm and an average shape factor $ML^2/A$ of 135.

<Preparation of Toner Mother Particles Y1>

Toner mother particles Y1 are prepared in the same manner as for the toner mother particles K1 except that the colored particle dispersion 4 is used instead of the colored particle dispersion 1. The toner mother particles Y1 thus obtained have D50 of 5.9 μm and an average shape factor $ML^2/A$ of 130.

<Preparation of Carrier>

14 parts by weight of toluene, 2 parts by weight of a styrene-methacrylate copolymer (component ratio: 90/10) and 0.2 parts by weight of a carbon black (R330, produced by Cabot Corporation) are mixed. The mixture is then stirred by a stirrer for 10 minutes to undergo dispersion. Thus, a coating solution is prepared. Subsequently, this coating solution and 100 parts by weight of a particulate ferrite (average particle diameter: 50 μm) are put in a vacuum-deaeration type kneader. The mixture is stirred at a temperature of 60° C. for 30 minutes, and then deaerated by reducing pressure upon heating so that it is dried to obtain a carrier. The carrier thus obtained have a volume intrinsic resistivity of $10^{11}$ Ω·cm upon the application of an electric field of 1,000 V/cm.

<Preparation of Toner 1 and Developing Agent 1>

100 parts by weight of each of the aforementioned toner mother particles K1, C1, M1 and Y1, 1 part by weight of a rutile type titanium oxide (particle diameter: 20 nm, treated with n-decyl trimethoxysilane), 2.0 parts by weight of silica (particle diameter: 40 nm, prepared by vapor phase oxidation method and treated with silicone oil), 1 part by weight of cerium oxide (average particle diameter; 0.7 μm) and 0.3 parts by weight of a higher aliphatic alcohol (higher aliphatic alcohol having a molecular weight of 700 is ground by a jet mill to an average particle diameter of 8.0 μm) are blended at a peripheral speed of 30 m/s using a 5L Henschel mixer for 15 minutes. Thereafter, using a sieve having a mesh size of 45 μm, coarse particles are removed to obtain a toner 1 (four colors: black, cyan, magenta, yellow). Using a V-blender, 100 parts by weight of the carrier and 5 parts by weight of the toner 1 are stirred at 40 rpm for 20 minutes. The mixture is then sieved through a sieve having a mesh size of 212 μm to obtain a developing agent 1 (four colors: black, cyan, magenta, yellow).

Developing Agent 2

<Preparation of Toner Mother Particles K2>

234 parts by weight of the dispersion of particulate resin (prepared during the preparation of the composite particles), 30 parts by weight of the aforementioned coloring agent dispersion 1, 40 parts by weight of the releasing agent dispersion, 0.5 parts by weight of polyaluminum hydroxide (Paho 2S, produced by Asada Chemical Co., Ltd.), and 600 parts by weight of ion-exchanged water are put in a round stainless steel flask. Using a homogenizer (Ultratalax T50, produced by IKA Japan K.K.), the mixture is stirred and dispersed. Thereafter, the mixture is heated with stirring over a heating oil bath to a temperature of 40° C. where it is then kept for 30 minutes. During this procedure, it is confirmed that agglomerated particles having D50 of 4.5 μm have been produced in the mixture. The temperature of the heating oil bath is then raised to 56° C. where the mixture is then kept for 1 hour. As a result, DSO of the agglomerated particles is 5.3 μm. To the dispersion containing these agglomerated particles are then added 26 parts by weight of the dispersion of particle resin. The dispersion is then kept at a temperature of 50° C. over a heating oil bath for 30 minutes. To the dispersion of these agglomerated particles is then added 1N sodium hydroxide to adjust pH of the dispersion to 7.0. Thereafter, the flask is hermetically sealed. Using a magnetic seal, the dispersion is then heated to 95° C. with stirring for 4 hours. The dispersion is cooled, and then filtered to withdraw the toner mother particles produced during dispersion. The toner mother particles are washed with ion-exchanged water four times, and then freeze-dried to obtain toner mother particles K2. The toner mother particles K2 have D50 of 5.8 μm and an average shape factor $ML^2/A$ of 109.

<Preparation of Toner Mother Particles C2>

Toner mother particles C2 are prepared in the same manner as for the toner mother particles K2 except that the colored particle dispersion 2 is used instead of the colored particle dispersion 1. The toner mother particles C2 thus obtained have D50 of 5.7 μm and an average shape factor $ML^2/A$ of 110.

<Preparation of Toner Mother Particles M2>

Toner mother particles M2 are prepared in the same manner as for the toner mother particles K2 except that the colored particle dispersion 3 is used instead of the colored particle dispersion 1. The toner mother particles M1 thus obtained have D50 of 5.6 μm and an average shape factor $ML^2/A$ of 114.

<Preparation of Toner Mother Particles Y2>

Toner mother particles Y2 are prepared in the same manner as for the toner mother particles K2 except that the colored particle dispersion 4 is used instead of the colored particle dispersion 1. The toner mother particles Y2 thus obtained have D50 of 5.8 μm and an average shape factor $ML^2/A$ of 108.

<Preparation of Toner 2 and Developing Agent 2>

A toner 2 and a developing agent 2 (four colors: black, cyan, magenta, yellow) are prepared in the same manner as for the toner 1 and developing agent 1 except that the toner mother particles K2, C2, M2 and Y2 are used and aluminum oxide (average particle diameter: 0.1 μm) is used instead of cerium oxide (average particle diameter: 0.7 μm).

Developing Agent 3

<Preparation of Toner Mother Particles K3>

100 parts by weight of a polyester resin (linear polyester obtained from terephthalic acid-bisphenol A ethylene oxide adduct-cyclohexane dimethanol; Tg: 62° C.; $M_n$: 12,000;

$M_W$: 32,000), 4 parts by weight of carbon black (Mogul L, produced by Cabot Corporation) and 5 parts by weight of a carnauba wax are kneaded using an extruder, and then ground using a jet mill. The ground material thus obtained is then classified by an air classifier to obtain toner mother particles K3. The toner mother particles K3 thus obtained have an average particle diameter of 5.9 μm and an average shape factor $ML^2/A$ of 145.

<Preparation of Toner Mother Particles C3>

Toner mother particles C3 are prepared in the same manner as for the toner mother particles K3 except that a cyan coloring agent (C.I. pigment blue 15:3) is used instead of carbon black. The toner mother particles C3 thus obtained have an average particle diameter of 5.6 μm and an average shape factor $ML^2/A$ of 141.

<Preparation of Toner Mother Particles M3>

Toner mother particles M3 are prepared in the same manner as for the toner mother particles K3 except that a Magenta coloring agent (R122) is used instead of carbon black. The toner mother particles M3 thus obtained have an average particle diameter of 5.9 μm and an average shape factor $ML^2/A$ of 149.

<Preparation of Toner Mother Particles Y3>

Toner mother particles Y3 are prepared in the same manner as for the toner mother particles K3 except that a yellow coloring agent (Y180) is used instead of carbon black. The toner mother particles Y3 thus obtained have an average particle diameter of 5.8 μm and an average shape factor $ML^2/A$ of 144.

<Preparation of Toner 3 and Developing Agent 3>

A toner 3 and a developing agent 3 (four colors: black, cyan, magenta, yellow) are prepared in the same manner as for the toner 2 and developing agent 2 except that the toner mother particles K3, C3, M3 and Y3 are used.

Examples 1 to 13 and Comparative Examples 1 to 6

In Examples 1 to 13 and Comparative Examples 1 to 6, electrophotographic photoreceptors, cleaning devices and developing agents are used in combination as set forth in Tables 1 and 2, respectively, to prepare tandem type color image forming apparatus having the structure shown in FIG. 8 (processing speed: 220 mm/sec, remodeled version of Docu Color 4040, produced by Fuji Xerox Co., Ltd.).

Subsequently, the image forming apparatus of Examples 1 to 13 and Comparative Examples 1 to 6 are each subjected to image formation test. In some detail, images are formed on 100,000 sheets of printing media at high temperature and humidity (30° C., 80% RH). Subsequently, images are formed on 100,000 sheets of printing media at low temperature and humidity (10° C., 20% RH).

After the formation of images, the wear rate (abrasion per 1,000 cycles) and the surface roughness of the electrophotographic photoreceptor, the presence of attached matters on the surface of the electrophotographic photoreceptor, the cleanability and transferability of toner at low temperature and humidity (contamination on charging unit and image quality deterioration due to malcleaning), and image quality are then evaluated. The results are set forth in Tables 1 and 2.

In Tables 1 and 2, the surface roughness (ten point-average surface roughness) of the electrophotographic photoreceptor is measured using SURFCOM 1400A (produced by TOKYO SEMITSU CO., LTD.) according to the measuring method defined in JIS B0601 (1994).

For the judgment of the presence of attached matters on the surface of the photoreceptor, the surface of the photoreceptor is visually observed. The results are then evaluated according to the following criterion:

G (good): No attached matters

F (fair): Attached matters observed on a part of the surface (not greater than about 30% of the entire surface)

P (poor): Attached matters observed

For the determination of the cleanability of the toner, the electrophotographic photoreceptor is visually observed. The results are then evaluated according to the following criterion:

G (good): Good

F (fair): Image defects such as streak observed on a part of the surface of the electrophotographic photoreceptor (not greater than about 10% of the entire surface)

P (poor): Image defects observed on wide area

For the determination of transferability, the toner left on the surface of the electrophotographic photoreceptor after transferring is transferred to an adhesive tape to measure the weight thereof. The efficiency of transfer is then calculated by the following equation (35):

$$\%\ \text{Efficiency of transfer} = \frac{(\text{Consumed toner amount [g]}) - (\text{Residual toner amount [g]})}{(\text{Consumed amount of toner})} \times 100 \quad (35)$$

With this efficiency of transfer as an index, evaluation is made according to the following criterion:

G (good): Transfer efficiency of not smaller than 90%;

F (fair): Transfer efficiency of from 86 to 90%;

P (poor): Transfer efficiency of less than 85%

TABLE 2

| | Photoreceptor | Cleaning device | Developing agent | Wear rate $W_0$ [mk-cycle] | Surface roughness $R_2$ [μm] | $R_2 \times W_0$ | Adhesion | Cleana-bility | Trans-ferability | Image quality |
|---|---|---|---|---|---|---|---|---|---|---|
| Example 1 | 1 | 1 | 1 | 0.8 | 0.4 | 0.32 | G | G | G | Some drop of density |
| Example 2 | 1 | 2 | 1 | 3.0 | 1.1 | 3.3 | G | G | G | G |
| Example 3 | 2 | 1 | 1 | 1.3 | 0.6 | 0.78 | G | G | G | G |
| Example 4 | 3 | 1 | 1 | 1.1 | 0.5 | 0.55 | G | G | G | Some drop of density |
| Example 5 | 4 | 1 | 1 | 1.5 | 0.6 | 0.80 | G | G | G | Some drop of density |
| Example 6 | 5 | 1 | 1 | 1.2 | 0.5 | 0.80 | G | G | G | Some drop of density |
| Example 7 | 5 | 2 | 1 | 4.5 | 1.5 | 6.75 | G | G | G | G |
| Example 8 | 6 | 1 | 1 | 3.5 | 1.3 | 4.55 | G | G | G | G |

TABLE 2-continued

| | Photoreceptor | Cleaning device | Developing agent | Wear rate $W_0$ [mk-cycle] | Surface roughness $R_2$ [μm] | $R_2 \times W_0$ | Adhesion | Cleana-bility | Trans-ferability | Image quality |
|---|---|---|---|---|---|---|---|---|---|---|
| Example 9 | 7 | 1 | 1 | 2.5 | 0.9 | 2.25 | G | G | G | G |
| Example 10 | 8 | 1 | 1 | 4.0 | 1.5 | 6.00 | G | G | G | G |
| Example 11 | 9 | 1 | 1 | 3.5 | 1.2 | 4.20 | G | G | G | G |
| Example 12 | 10 | 1 | 1 | 1.5 | 0.5 | 0.75 | G | G | G | Some drop of density |
| Example 13 | 10 | 2 | 1 | 6.5 | 1.8 | 11.7 | G | G | G | Some drop of density |
| Comparative Example 1 | 11 | 1 | 1 | 8.5 | 2.5 | 21.3 | G | G | G | Streak occur |
| Comparative Example 2 | 11 | 2 | 1 | 25 | 6.0 | 150 | G | P | G | Streak occur |
| Comparative Example 3 | 1 | 4 | 1 | 3.0 | 0.8 | 2.40 | F | P | F | Streak occur on entire surface |
| Comparative Example 4 | 3 | 4 | 1 | 2.5 | 1.5 | 3.75 | F | P | F | Streak occur on entire surface |
| Comparative Example 5 | 9 | 4 | 1 | 6.0 | 1.9 | 11.4 | F | P | F | Streak occur on entire surface |
| Comparative Example 6 | 11 | 3 | 1 | 15 | 2.2 | 33.0 | G | G | G | Streak occur on entire surface |

As mentioned above, the image forming apparatus of the invention makes it sure to remove residual toner from the electrophotographic photoreceptor without causing damage on the electrophotographic photoreceptor, filming by agglomerated external additives for toner, passage of toner, etc. Thus, the resulting image forming apparatus can be provided with a higher operation speed, a higher performance and a prolonged life.

While the invention has been described in detail and with reference to specific examples thereof, it will be apparent to one skilled in the art that various changes and modifications can be made therein without departing from the spirit and scope thereof.

What is claimed is:

1. A process for forming an image comprising:

charging an electrophotographic photoreceptor having an electrically-conductive support and a photosensitive layer provided on said support;

exposing said electrostatically charged electrophotographic photoreceptor to light to form an electrostatic latent image;

developing said electrostatic latent image with a toner to form a toner image;

transferring said toner image onto a transferring medium; and cleaning said electrophotographic photoreceptor after the transfer of said toner image to remove a toner left thereon, wherein said electrophotographic photoreceptor comprises a surface layer containing a siloxane-based resin having charge-transporting properties and a crosslinked structure, wherein said cleaning step is carried out with a brush member disposed such that the leading end of said brush comes in contact with said electrophotographic photoreceptor, wherein the product ($R_z \times W_e$) of the surface roughness ($R_z$, μm) of said electrophotographic photoreceptor after 200,000 rotations thereof and the wear rate of said electrophotographic photoreceptor per 1,000 rotations ($W_e$, nm) is not greater than 20, wherein said brush member comprises resin fibers selected from the group consisting of polyamide, polyacrylate, polyolefin and polyester and having a fiber diameter of not greater than 30 denier, said resin fiber being arranged at a density of not smaller than 20,000 fibers/inch$^2$, and wherein the intrusion depth of the leading end of said brush into said electrophotographic photoreceptor is from 0.1 to 2.5 mm.

2. The process for forming an image according to claim 1, wherein said brush member is electrically conductive, and a predetermined voltage is applied across said electrophotographic photoreceptor and said brush member to remove the toner left on said electrophotographic photoreceptor.

3. The process for forming an image according to claim 1, wherein said toner has an average shape factor of from 115 to 140 as measured by the formula:

$$\text{Shape factor } (ML^2/A) = (\text{maximum lenght})^2 \times \pi \times 100/(4 \times (\text{area})).$$

4. The process for forming an image according to claim 1, wherein said brush member is a roll-shaped brush member which can rotate around a rotational axis parallel to a line tangential to said electrophotographic photoreceptor, and said cleaning device further comprises:

a recovery roll member which is disposed so as to come in contact with the leading end of said brush member and can rotate around a rotational axis parallel to the rotational axis of said brush member: and a scraper or blade member disposed in contact with the periphery of said recovery roll member.

5. The process for forming an image according to claim 1, wherein said surface layer further comprises aluminum element in an amount of from 0.1 to 10% by weight.

6. The process for forming an image according to claim 1, wherein said surface layer further comprises a fine particulate material having an average particle diameter of from 5 to 1,000 nm.

7. The process for forming an image according to claim 1, wherein said surface layer further comprises an alcohol-soluble resin in an amount of from 5 to 20% by weight.

8. The process for forming an image according to claim 1, wherein said surface layer further comprises an oxidation inhibitor in an amount of from 0.1 to 20% by weight.

9. The process for forming an image according to claim 1, wherein said siloxane-based resin is derived from a silicon-containing compound represented by the following general formula (1):

$$W(\text{-}D\text{-}SiR_{3-a}Q_a)_b \quad (1)$$

wherein W represents an organic group having charge-transporting property; R represents one group selected from the group consisting of hydrogen atom, alkyl group and substituted or unsubstituted aryl group; Q represents a hydrolyzable group; D represents a divalent group; the suffix a represents an integer of from 1 to 3; and the suffix b represents an integer of from 1 to 4.

10. The process for forming an image according to claim 9, wherein said silicon-containing compound is a compound represented by the following general formula (2):

(2)

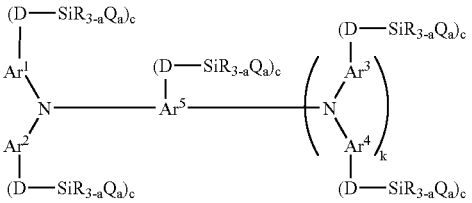

wherein $Ar^1$ to $Ar^4$ may be the same or different and each represent a substituted or unsubstituted aryl group; $Ar^5$ represents a substituted or unsubstituted aryl or arylene group; R represents one group selected from the group consisting of hydrogen atom, alkyl group and substituted or unsubstituted aryl group; Q represents a hydrolyzable group; D represents a divalent group; the suffix a represents an integer of from 1 to 3; and the suffixes c each independently represent 0 or 1, with the proviso that the total number of the groups represented by $\text{-}D\text{-}SiR_{3-a}Q_a$ is from 1 to 4.

11. The process for forming an image according to claim 1, wherein said photosensitive layer comprises at least one phthalocyanine compound.

12. The process for forming an image according to claim 1, wherein said electrophotographic photoreceptor rotates at a processing speed of not lower than 150 mm/s.

* * * * *